United States Patent [19]

Orr

[11] Patent Number: 4,569,461

[45] Date of Patent: Feb. 11, 1986

[54] SINGLE COPY NEWSPAPER DISPENSING MACHINE

[75] Inventor: Don Orr, Arnolds Park, Iowa

[73] Assignee: Berkley-Small, Inc., Mobile, Ala.

[21] Appl. No.: 403,789

[22] Filed: Jul. 30, 1982

[51] Int. Cl.[4] ..... G07F 11/22

[52] U.S. Cl. ..... 221/1; 221/227; 221/232; 221/259

[58] Field of Search ..... 221/1, 227–229, 221/232, 259

[56] References Cited

U.S. PATENT DOCUMENTS

| | | | |
|---|---|---|---|
| 382,521 | 5/1888 | Galland . | |
| 3,114,475 | 12/1963 | Etes . | |
| 3,263,859 | 8/1966 | Searle . | |
| 3,318,478 | 5/1967 | Hart . | |
| 3,536,231 | 10/1970 | Knickerbocker | 221/155 |
| 3,747,733 | 7/1973 | Knickerbocker | 221/103 X |
| 3,749,281 | 7/1973 | Stovers | 221/298 |
| 4,140,243 | 2/1979 | Etes | 221/227 X |
| 4,258,861 | 3/1981 | Traill et al. | 221/227 X |
| 4,367,826 | 1/1983 | Glaser | 221/232 X |
| 4,413,749 | 11/1983 | Glaser | 221/1 |

*Primary Examiner*—Charles A. Marmor

*Attorney, Agent, or Firm*—Pearne, Gordon, Sessions, McCoy, Granger & Tilberry

[57] ABSTRACT

A device is provided to store a vertical stack of newspapers in a free standing cabinet and to automatically dispense individual copies actuated by the opening of a cabinet door. The dispensing mechanism is adapted to readily retro-fit prior art honor system type newspaper vending machines and is capable of dispensing daily and Sunday newspapers irrespective of varying thicknesses or numbers of inserts. A novel high velocity paper dispenser mechanism is employed to overcome the inertia of the single copy to be dispensed and to quickly shear the frictional bond between the said single copy and the subjacent newspaper.

5 Claims, 17 Drawing Figures

SINGLE COPY NEWSPAPER DISPENSING MACHINE

BACKGROUND OF THE INVENTION

This invention pertains to the art of newspaper vending machines, and in particular to the art of vending machines which dispense one newspaper at a time.

Single copy newspaper dispensing machines have been known in the prior art for many years, and efforts to develop a practical single copy newspaper dispensing machine have been almost continuous.

However, there is not known to the applicant a single machine in commercial use in the United States or in any foreign country which successfully dispenses single copies of newspapers.

The newspaper dispensing machine almost universally used in the United States is an honor system type cabinet in which newspapers are stored, and to which the customer has full access upon insertion of the proper number of coins in the coin box. This mechanism comprises a cabinet of sufficient size to store a stack of newspapers, a coin operated latch release mechanism and a newspaper access door normally mounted on the cabinet to swing outwardly and downwardly, exposing the entire stack of papers to the purchaser. In theory, the purchaser is supposed to take one newspaper and then permit the door to swing closed and relock in preparation for the next customer who will then also insert the proper coins. Unfortunately, it has been the experience of the newspaper publishing industry that the honor system is for the most part honored in the breach.

Loss of income due to theft of newspapers from honor type newspaper dispensers varies from locality to locality, but even the theft of a single newspaper per box in a large metropolitain area, such as New York City, having 20,000 honor system type dispensers, could entail a loss of as much as $5,000.00 per day of income. Actually, average losses per dispenser are known to run at about 25% to 30% of the newspapers sold in dispensers. Thus, the average daily loss in New York City is closer to $40,000.00 per day or more. Nor is New York City an exceptional situation. This same rate of loss is experienced in most metropolitain areas throughout the United States.

There has been, therefore, a long felt need for a single copy dispensing device which will cut down losses presently being suffered in honor system type newspaper vending machines. However, it is believed there are at present approximately five-hundred thousand units currently in use throughout the United States. Accordingly, means for retro-fitting present dispensing cabinets with a reliable single copy newspaper dispenser module at considerably less cost than replacing the entire machine, would be additionally attractive to the newspaper industry.

THEORY OF THE INVENTION

Newton's first law of motion states, in part, that an object at rest will remain at rest unless acted upon by an unbalanced outside force. In the present invention, a newspaper is the object at rest and the application to the newspaper of the dispensing means of the subject invention is the unbalanced outside force. The dispensing means acts upon the top newspaper of a stack of newspapers with a force to overcome its static inertia and to set it into motion. However, this force must not be so great as to also set the first subjacent newspaper into motion as well. Thus, the combination of the static inertia of the first subjacent newspaper and the frictional bond between it and the second subjacent newspaper must be sufficient to cause a shear of the frictional bond between the top newspaper and the first subjacent newspaper when the top newspaper is accelerated at a sufficiently rapid rate. It is necessary, therefore, that there must exist a proper relationship between the forces and acceleration applied by the dispensing means to the top newspaper and the static inertia and frictional bond between the first and second subjacent newspapers. The subject invention provides the proper forces and acceleration to the top newspaper to cleanly and consistently shear the top newspaper from the first subjacent newspaper. Furthermore, the invention is capable of accelerating and thus dispensing a wide range of newspaper shapes and masses without need for any adjustment in the motivating forces. It is estimated that at least 90% of the newspapers presently published in the United States can be successfully dispensed by the subject invention.

GENERAL OPERATION OF THE INVENTION

In a preferred commercial embodiment, the invention comprises a self-contained modular chassis adapted to fit within the interior dimensions of coin operated honor system type newspaper cabinets.

After prior art cabinets have been retro-fitted with the subJect invention, the inventive newspaper dispensing device will be actuated by the same operation of inserting coins and pulling the prior art access door out and down. The door's principal function in the retro-fit, however, is to serve as a source of energy to power the necessary mechanism for dispensing a single newspaper through a slot in a security or access panel positioned just inside the prior art access door. Upon closing the prior art access door, hereinafter referred to as the "outer door", all parts return to their starting positions in readiness for another transaction.

A few easily made modifications of the prior art cabinet enable the invention module to be quickly secured within the cabinet and for equally quick removal for maintenance and servicing. The module includes a spring biased newspaper supporting and elevating platform upon which a bundle of newspapers are vertically stacked for upward movement. The stack is brought to rest beneath and in pressure engagement with the underside of the newspaper dispensing module so that the newspaper on the top of the stack is positioned approximately in horizontal alignment with a slot in the access panel. When the outer door is unlatched by the customary insertion of the proper coins in the coin box, the purchaser pulls the door downwardly, as in the past. However, with the subject invention, there is set into motion a kinematic coaction between parts of the module to dispense a single copy of a newspaper.

First, there is brought about a lowering of the elevator platform to permit the top paper to be released from pressure contact with the module for uninhibited removal from the vending machine. At the same time, operational springs are being energized by the opening of the outer door. A dispensing platen is adapted to freely float on the top surface of the top newspaper. A pair of crank arms, secured to a spring biased rotatable shaft, urge the dispensing platen in a sweeping motion towards the slot in the vertical access panel. The frictional forces between the dispensing platen and the top newspaper in combination with the quick acceleration applied to the dispensing platen is sufficient to overcome the static inertia of the top newspaper as well as the frictional bond between the top newspaper and the next subjacent newspaper. It is the combination of quickness of acceleration and the right balance of forces of the dispensing platen which contribute to the success of the dispensing of the top newspaper through the horizontal slot of the retro-fit access panel. To increase the coefficient of friction of the platen and the frictional engagement between the newspaper dispensing platen and the top newspaper, the under surface of the platen is provided with a resilient pad having excellent gripping qualities. The top newspaper is transported horizontally a distance sufficient to enable the purchaser to grip the leading edge of the newspaper for final removal from the dispensing machine. As soon as the top newspaper moves forward, the subjacent newspaper is clamped against removal. This clamping force acts to lower the stack even further to provide clearance for the return stroke of the dispensing platen. Thereafter, cam timing means cause the spring energized rotatable shaft and crank arm means to return the dispensing platen to its initial position.

Ancillary to this dispensing operation, a positively held in place horizontal slot cover plate is vertically disposed and adapted to be released and lifted upwardly in synchronous timed relationship with the newspaper dispensing action just described to permit movement of the newspaper through the slot. After the newspaper has been dispensed, the cover plate is permitted to return downwardly, again covering the slot and being positively held in place to discourage paper theft and tampering with the mechanism.

Means are also provided for placing a display newspaper in a transparent locked compartment. This compartment will automatically unlock when the last newspaper on the elevator platform has been dispensed, thereby permitting sale of all of the newspapers in the vending machine.

After the top paper of a stack of newspapers has been dispensed, the elevator platform is again raised to bias the new top newspaper upwardly against the underside of the dispensing module.

The subject invention is capable of dispensing newspapers of only a few sheets, such as are sometimes found in suburban areas and small towns, all intermediate sizes of newspapers, with and without inserts and supplements, and large metropolitan Sundy edition newspapers replete with numerous inserts. Within reasonable limits, no adjustments need be made to the dispensing mechanism to accommodate newspapers of any of these various thicknesses. However, as to the extremely thick newspapers, such as metropolitan Sunday editions, hook means are provided which coact with the dispenser platen as an aid in preventing segmental movement of the paper being dispensed. This hook means is manually set by the deliveryman at the time that extra thick newspapers are loaded in the vending machine.

THE PRIOR ART

Applicant is aware of numerous patents which deal with single copy newspaper dispensing. Thus, as early as the year 1888, a U.S. patent was issued to Galland, Pat. No. 382,521, which shows a spring biased newspaper elevator for urging a stack of newspapers upwardly to align the top newspaper for horizontal dispensing through a slot in the cabinet of the machine. The newspaper dispensing mechanism was positioned in the upper part of the cabinet and was actuated by pulling a rod outwardly from the cabinet to dispense a newspaper.

The below listed U.S. patents, at least in general terms, disclose an organization of parts which claim to coact to dispense a single newspaper responsive to the insertion of the proper coins and the actuation of a newspaper dispensing rod. Weller, U.S. Pat. Nos. 479,688; Slater, 494,444; Watlington, 3,042,250; Etes, 3,114,475: Hart, 3,331 478; Kalafsky, 3,537,615; Etes, 4,140,243; Owens, 4,174,047; Traill, 4,258,861; and, Overall, 4,273,255.

It is also known in the prior art for a newspaper access door, hinged to swing outwardly and downwardly, to function as a lever to actuate the dispensing mechanism. This broad concept is shown in the United States Knickerbocker Pat. No. 3,747,733. Also in broad context, the U.S. patent to Etes, Pat. No. 3,114,475, shows one form of an embodiment of an access door in which the display newspaper may be locked in place until the last paper from the vertical stack of newspapers has been sold.

Applicant's invention differs from all of the above noted prior art disclosures, not only as to specific utilization of means to form specified functions, but also as to the coaction of the various components of applicant's device which combine to produce a successful result unobtainable by any of the prior art devices. By way of example, the prior art devices fail to show any means to retro-fit modern newspaper vending machines; the prior art fails to disclose a means for successfully dispensing newspapers of various thicknesses and with various numbers of inserts; and the prior art devices fail to disclose a successful means of ejecting a newspaper from a dispensing device without using positive physical gripping means such as pins and/or fingers in order to dislodge the top newspaper from a stack of newspapers. Most importantly, none of the prior art patents known to the applicant recognize, discuss or otherwise deal with the problem of frictional bond between newspapers, or how to overcome the static inertia of a top newspaper without disturbing the static inertia of the next subjacent newspaper. Finally, applicant is not aware of any prior art mechanism which has ever been a commercial success.

OBJECTS OF THE INVENTION

It is therefore among the objects of the invention to provide a single copy newspaper dispensing mechanism which is suitable for retro-fitting a prior art coin operated honor system type newspaper vending machine; which is quickly insertable into and removable from a prior art honor system type newspaper vending cabinet; which can be energized and actuated by a prior art access door; which requires no exterior modification to a prior art cabinet; which does not alter the external appearance of a retrofitted cabinet; which requires no re-education of a newspaper purchaser to operate a retro-fitted vending machine; which is suitable.for use in other types of cabinet structures; which dispenses papers of varying thicknesses without adjustment; which will dispense newspapers with inserts; which will dispense large metropolitan Sunday newspapers together with Sunday supplements and inserts; which utilizes a novel dispensing mechanism; which utilizes novel spring loaded sources of energy; which provides a novel means of dispensing newspapers; which provides a novel access panel; which provides a novel means to display and to vend a newspaper copy stored in the outer door; and which utilizes novel means to overcome the static inertia of a newspaper to be dispensed without disturbing the static inertia of the next subjacent newspaper in a vertical stack of newspapers. These and other objects will become apparent by referring to the following specification, drawings and claims.

GENERAL DISCUSSION OF THE INVENTION

Figure 1:
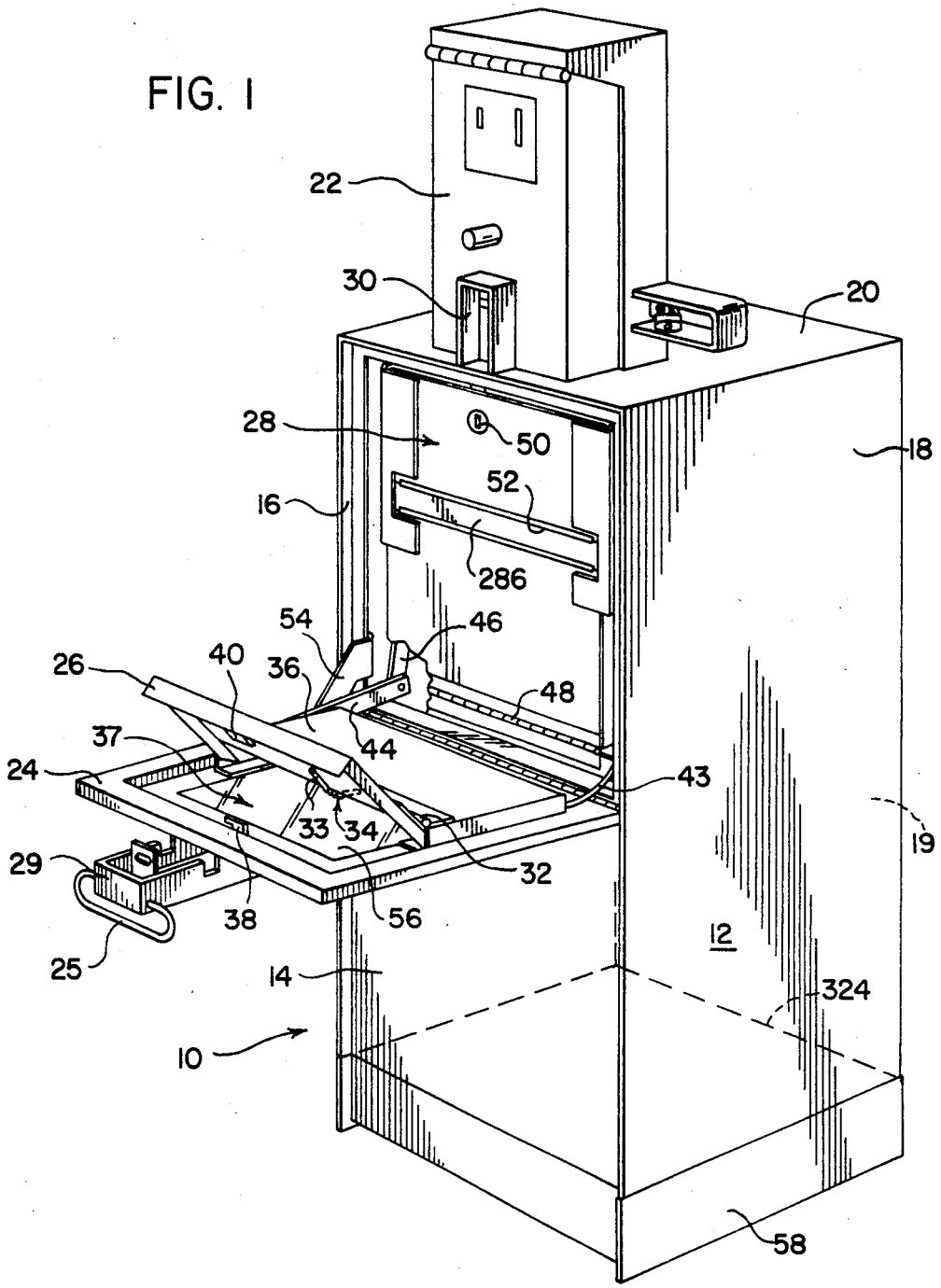
FIG. 1 is an elevational view, in perspective, of a preferred embodiment of the invention showing the outer and inner doors in the open positions.

This invention utilizes the forces of inertia, impulse, acceleration, momentum and friction to shear a newspaper from the top of a stack of newspapers and to impart to said newspaper sufficient acceleration and momentum that the static inertia and frictional resistance to motion of the next subjacent newspaper will not be overcome. Sufficient momentum is imparted to the top newspaper to carry it horizontally forward a predetermined distance through a dispensing slot in the cabinet of a newspaper vending machine. By utilizing these physical principles, the subject invention is capable of dispensing a top newspaper from a stack of newspapers selected from a wide variety of newspapers of various thicknesses, weights, shapes and coefficients of friction without having to adjust the inventive dispensing means depending on the particular physical properties of newspapers being dispensed. In accordance with the invention, applicant has discovered that if the top newspaper can be accelerated fast enough, the subjacent newspaper will remain at rest. The principle involved is aptly demonstrated by, and similar to, the familiar parlor stunt of whisking a tablecloth from beneath a table setting of dishware without disturbing the dishware.

Because newspaper readers find pin pricks and similar indentations objectionable in newspapers caused by positive prior art grippers, applicant has utilized a non-destructive newspaper dispenser platen. The underside of this platen is lined with a flat pad of polyurethane foam, or similar material, having a coefficient of friction between the pad and newspaper in the range of three times the coefficient of friction between adjacent newspapers.

In a preferred embodiment of the invention, applicant has discovered that a newspaper dispenser platen weighing within a range of from one to three pounds and having a surface area within a range of from one-quarter to threequarters of the surface area of a folded newspaper yields acceptable performance. In the preferred embodiment of the invention optimum performance has been obtained with a two pound platen having a newspaper contact surface of approximately one-half of the surface area of a folded portion of a newspaper.

Dispensing platen accelerating thrust may be obtained from a wide range of mechanical and electrical devices. However, applicant has found that the thrust obtained from torsioned metal springs works very well. In addition, metal springs are relatively inexpensive, trouble free, long lasting and impervious to wide fluctuations of temperature and weather. Nevertheless, it is recognized that other sources of energy may be utilized to operate a practical embodiment of the invention, such as air springs and other fluid pressure devices, weight actuated lever means, bottled gas, explosive charges and electrical devices.

In a preferred embodiment of the invention, applicant has used metal springs torsioned to provide approximately a six pound initial thrust to the dispenser platen, which thrust decays to about four pounds at the end of the dispensing stroke portion of the cycle. Applicant has determined that with a two pound dispensing platen having a surface area of approximately eighty square inches, and a coefficient of friction of approximately three times the coefficient of paper to paper, this platen is adequate to successfully and repetitively dispense most newspapers presently published in the United States. Furthermore, as aforesaid, the invention is capable of accepting and dispensing thin newspapers, medium size newspapers and thick newspapers without need to adjust the dispenser to suit the physical properties of a particular stack of newspapers. This lack of need for adjustment is best demonstrated by the fact that it is possible to randomly load the retro-fitted cabinet with an indescriminate mix of thin, medium, and thick newspapers in one stack, a situation never encountered in the field. The invention can sequentially dispense this stack of random size newspapers without misfeeding. Furthermore, inserts and supplements may be dispersed throughout the stack without inhibiting the ability of the invention to dispense each and every newspaper without difficulty. Although it is not expected that a random mix of several sized newspapers will, within the foreseeable future, be sold from vending machines on a commercial basis, the capability is nevertheless inherent in the present invention, and demonstrates a margin of reliability in excess of commercial requirements.

DETAILED DISCUSSION OF THE DRAWINGS

For ease in following a detailed description of a preferred embodiment of the invention, the invention has been divided and grouped into component parts and sub-assemblies which will be separately explained and discussed. Thereafter, the interrelationship, function and timed sequences of the separately discussed component parts and subassemblies, coacting and cooperating to achieve a predetermined end result, will be described in a manner best calculated to provide the fullest understanding of the operation of the invention as a whole.

Since there are three principal shafts which are rotated during a newspaper dispensing cycle, whether the rotation is clockwise or counterclockwise, is of course relative depending on the vantage point of the viewer. Accordingly, unless exception is noted, the direction in which a shaft appears to rotate will be determined by the particular figure under discussion at the time. It is possible, therefore, that a shaft may be described as rotating clockwise as viewed in one figure but, at the same time, will appear to be rotating counterclockwise as viewed in another figure.

THE CABINET

Referring now to FIG. 1, therein is shown in accordance with the invention, a retro-fitted standard honor system type newspaper vending machine 10 comprising a rectangular cabinet 12 having a lower front panel 14, left and right side panels 16 and 18, respectively, a rear panel 19, a top panel 20, a coin actuated outer door latch release box 22, an outer door 24, a display paper vending inner door 26 and an inner security or access panel 28. The cabinet 12, the coin actuated outer door latch release box 22, the outer door 24, and latching portions 29 and 30 are well known in the prior art and do not constitute a portion of the invention. What is novel and comprises a portion of applicant's invention is the modification to the backside of the outer door 24, including the hinged inner door 26 adapted to pivot away from the main door 24 about hinge means 32 into the position shown. The inner door 26 is spring biased into the position shown and one end 33 of the spring biasing means 34 can be seen. The backside of the outer door 24 is further modified with a lower half panel 36 which coacts with inner door 26 to form a display newspaper compartment 37.

A latch 38, slidably mounted on the upper inside edge of outer door 24, is adapted to make latching engagement with the latch keeper 40 mounted on the upper inside edge of inner door 26. Latch 38 is spring biased into engagement with keeper 40 and is withdrawn therefrom by flexible cable means, a portion of which is shown at 43. When latch 38 is withdrawn from keeper 40, spring biasing means 34 urges inner door 26 into the open position. A lever 44, as shown on the lower left side of outer door 24, is provided to initiate actuation of the dispensing mechanism, as will be further described hereinafter. Lever 44 is pivotally connected to the lower end of a two piece connecting member 46, also to be described in greater detail hereinafter.

Access panel 28 is secured by horizontal hinge means 48 to permit the access panel to swing outwardly and downwardly. When in the closed position, as shown, it is locked by key operated lock means 50. A horizontal slot 52 is formed in access door 28 through which a single copy of a newspaper is dispensed in accordance with the invention. Arcuate movement of outer door 24 is delimited by stop plate means 54, as is standard in the prior art. The outer door 24 is provided with a prior art window 56 for purposes of displaying the edition of the newspaper currently on sale in the vending machine. The cabinet may be positioned on any suitable base means 58.

Figures 2, 3:
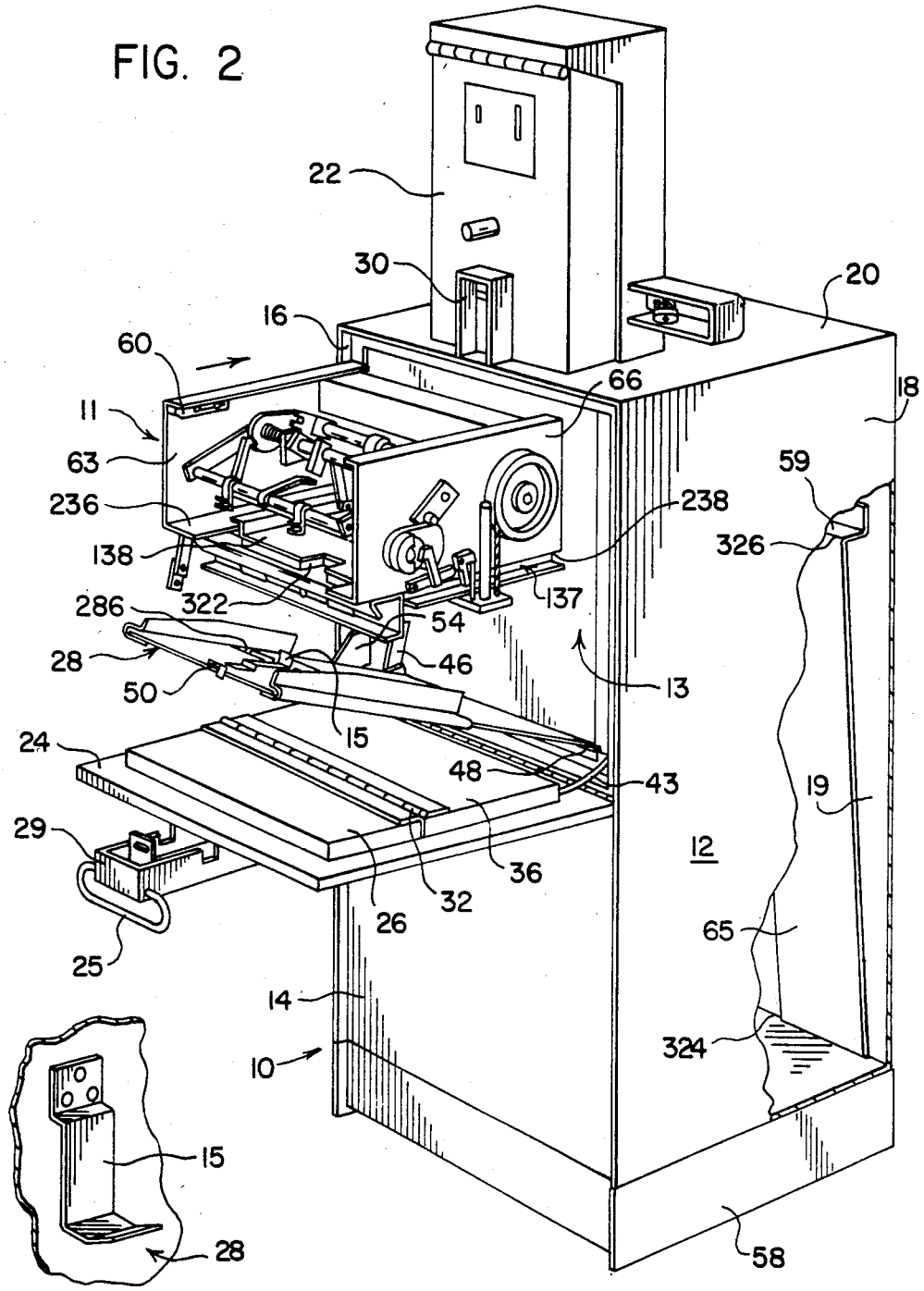
FIG. 2 is an elevational view, in perspective, of a preferred embodiment of the invention showing the dispensing module removed from the cabinet.
FIG. 3 is an enlarged fragmentary perspective of the newspaper depressor shown in FIG. 2.

FIG. 2 is similar to FIG. 1, but shows the hinged inner door 26 in the closed and latched position and access panel 28 in the unlocked open position. Additionally, the retro-fit dispensing module 11 is shown as it would appear just prior to inserting the module in the opening 13 created by swinging access panel 28 arcuately outward as shown. The back edges of the lower side rails 236 and 238 of the module 11 rest on flange 59. The front end of the module 11 is secured in the cabinet 12 by slidable latch bars 60 mounted on the inner faces of the module side panels 63 and 66. These latch bars are better shown and described in the following discussion of FIG. 4.

FIG. 3 is an enlarged fragmentary view in perspective of a newspaper depressor tongue 15 mounted on the inside face of access panel 28. Tongue 15 is adapted to be received in slot 322 of dispenser platen 138 when access panel 28 is in the closed position of FIG. 1, and the dispenser platen 138 is in the forward position shown in FIG. 2. The purpose and function of depressor tongue 15 will be described more fully hereinafter.

Figure 4:
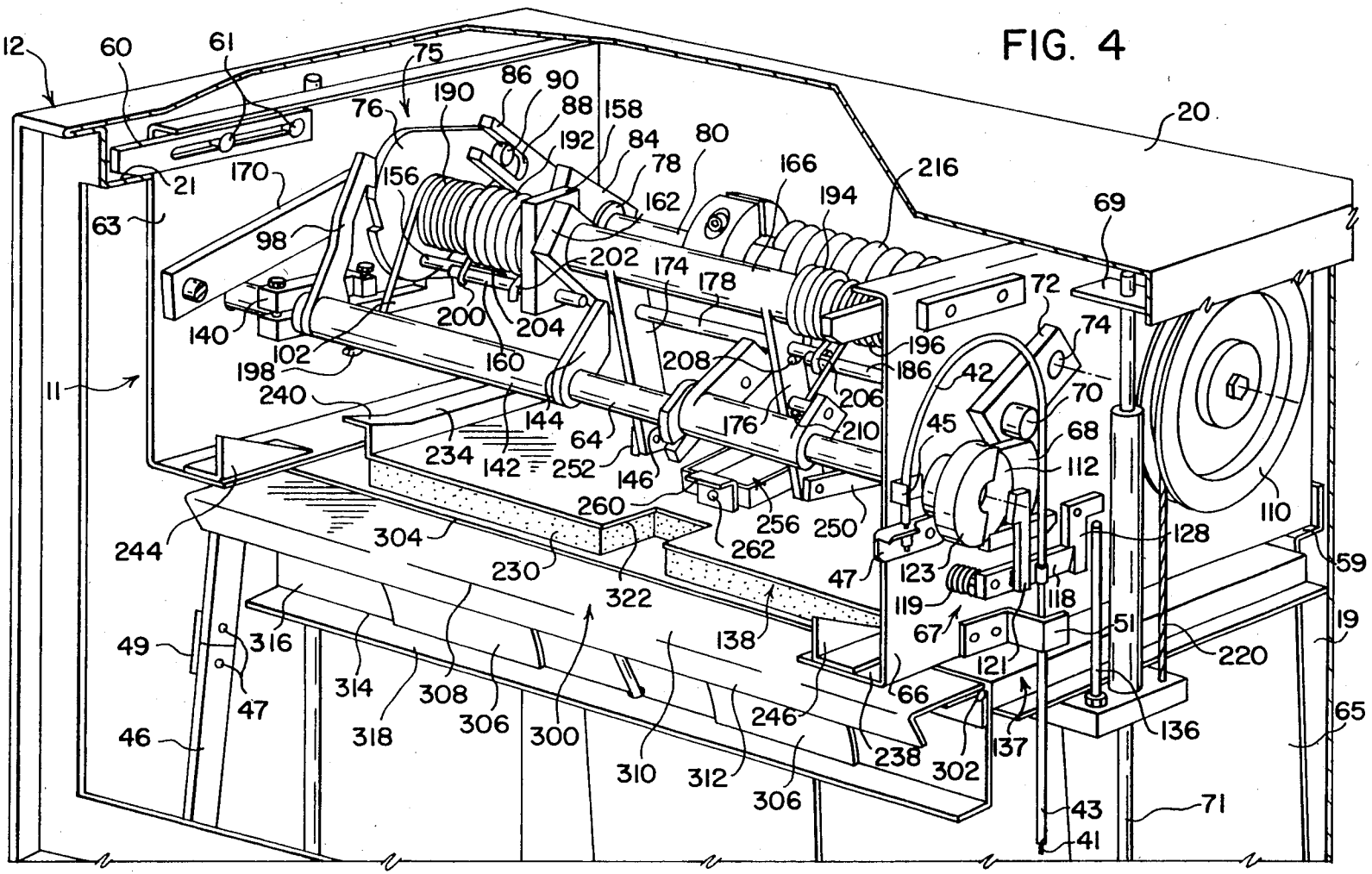
FIG. 4 is a fragmentary elevational view, in perspective, and partially in section, showing the upper portion of the cabinet and the newspaper dispensing mechanism as viewed looking toward the right front corner of the newspaper dispensing cabinet.

Referring now to FIG. 4, as aforesaid, a ledge 59 has been added to the inner face of rear panel 19 to support the lower rear portion of the dispensing module 11. The slotted latch bars 60 are mounted to slide on pins 61 on module side panels 63 and 66 to engage a horizontally inwardly extending flange 21 of cabinet 12. Newspaper alignment guide panels 65, FIG. 2, extend from the inner lower edge 324 of rear panel 19 to the outer edge 326 of ledge 59. Guide panel 65 aligns and shifts newspapers slightly forward which are stacked in the cabinet 12 as the newspapers progress upwardly in the cabinet prior to being dispensed. With the newspaper shifted away from the back panel 19, clearance is thus provided between the newspapers and back panel 19 for a dispensing means bracket, to be described hereinafter. Platform guide post means 71 and guide post brackets 69 are standard equipment in some prior art cabinets, but may be easily added to the retro-fitted cabinet if required.

In order to remove a module 11 from cabinet 12, latch bars 60 are shifted rearwardly, two piece connector 46 is separated by unfastening threaded fasteners 47 from backing plate 49, and cable 43 is disconnected from outer door 24, FIG. 1. To insert a module 11 in cabinet 12, the procedure is, of course, just reversed. The lower rear surface of module 11 is rested on ledge 59, slotted latch bars 60 are pushed forward onto flange 21, two piece connector 46 is reassembled and cable 43 is reconnected to outer door 24. The removal or installation of a module can be accomplished in less than two minutes by a trained but unskilled or semi-skilled laborer.

The Power Train

Figure 5:
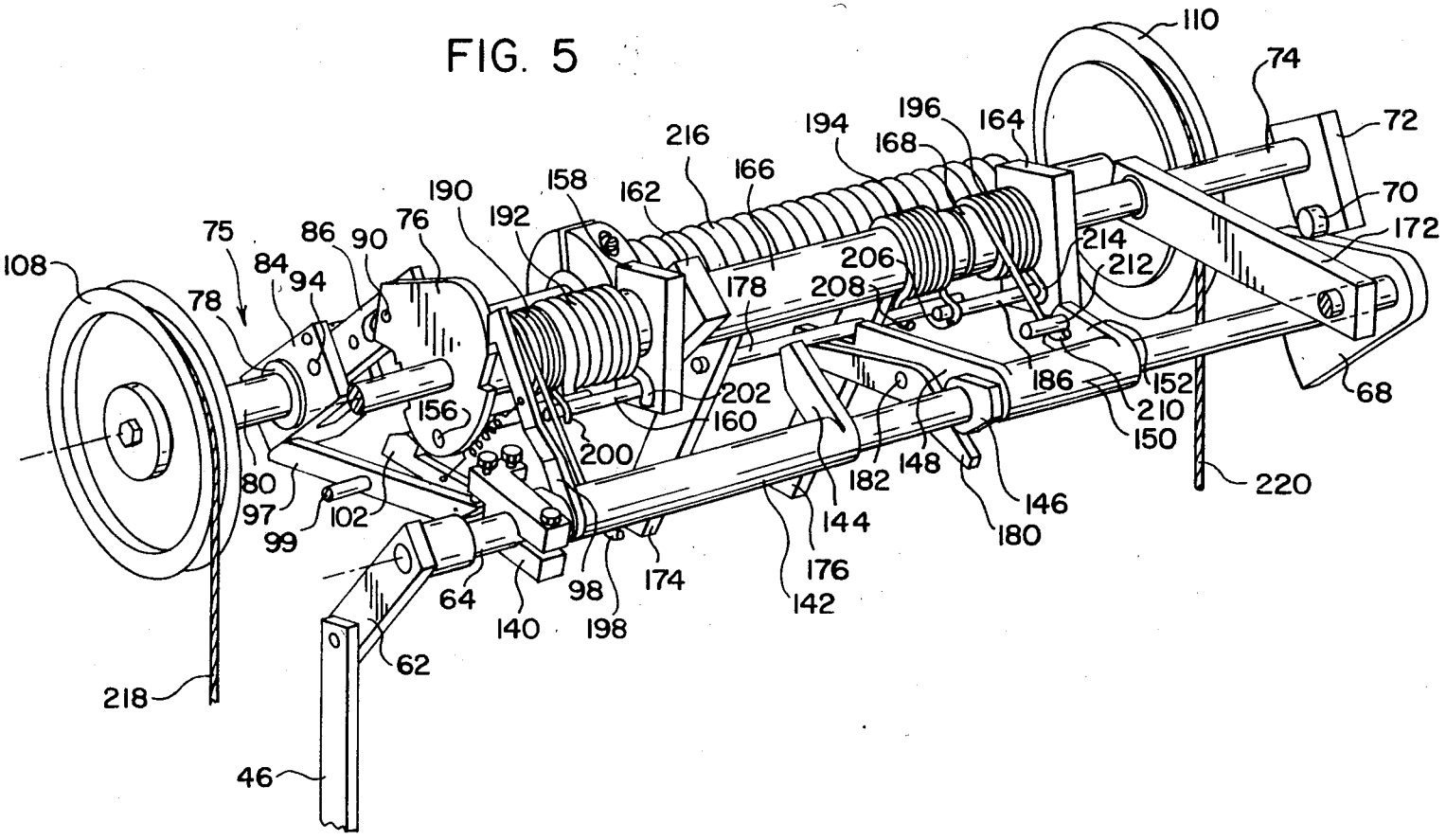
FIG. 5 is a partial elevational perspective view of the dispensing mechanism as viewed looking toward the left front portion of the mechanism.

Reference is now made to FIGS. 4 and 5, wherein the newspaper dispensing mechanism's power train is disclosed. The lower end of connecting link 46 is shown in FIG. 1. The upper end of this link is shown in FIGS. 4 and 5 and on the left side of the mechanism. FIGS. 4 and 5 are both perspective views of the operating mechanism viewed from different points of vantage. Whereas FIG. 4 is viewed by a person looking toward the front right side of the mechanism, FIG. 5 is viewed by a person looking toward the left front side of the mechanism.

Figure 6:
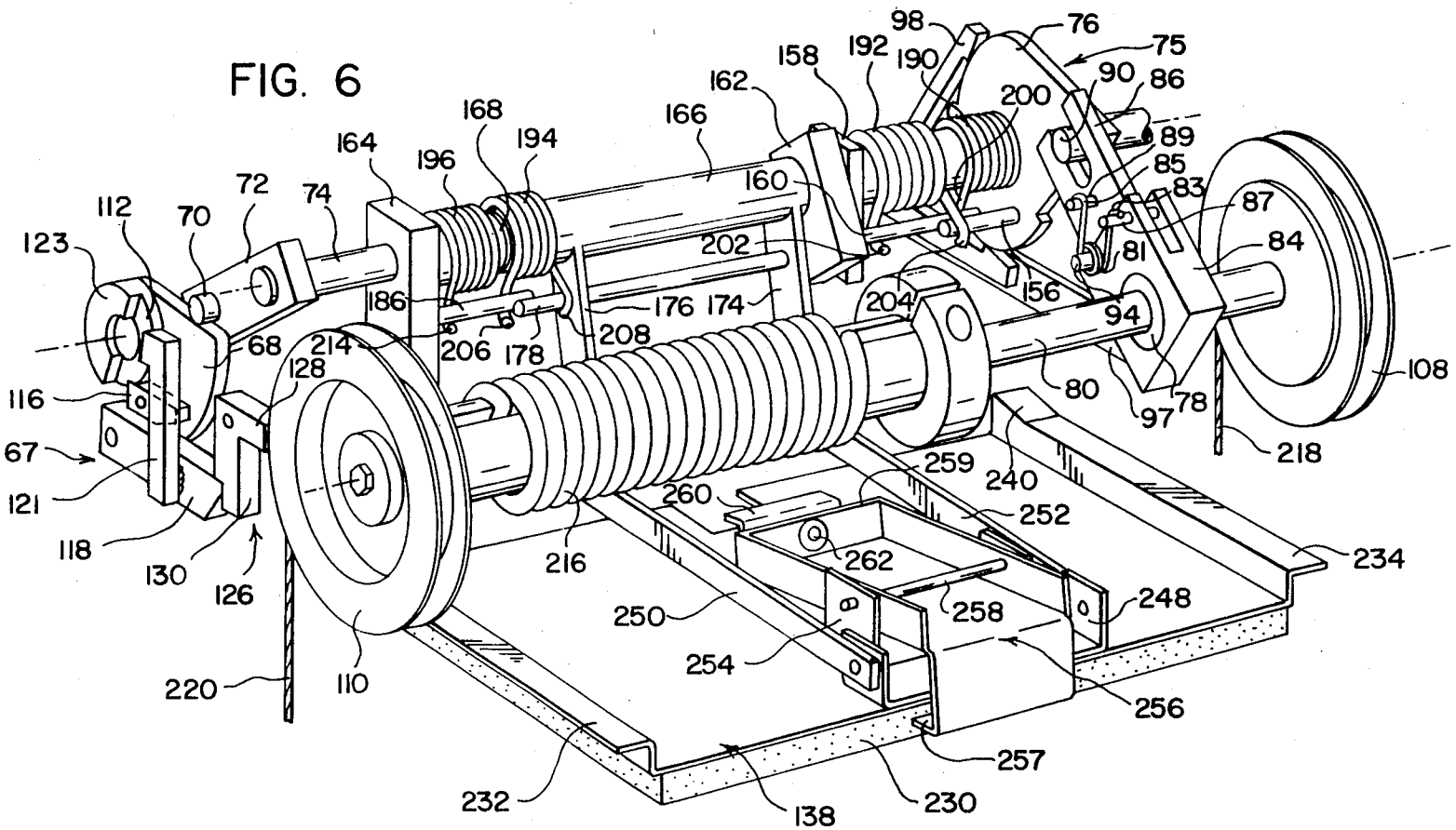
FIG. 6 is a rear elevational view, in perspective, of the mechanism substantially shown in FIG. 5.
Figure 7:
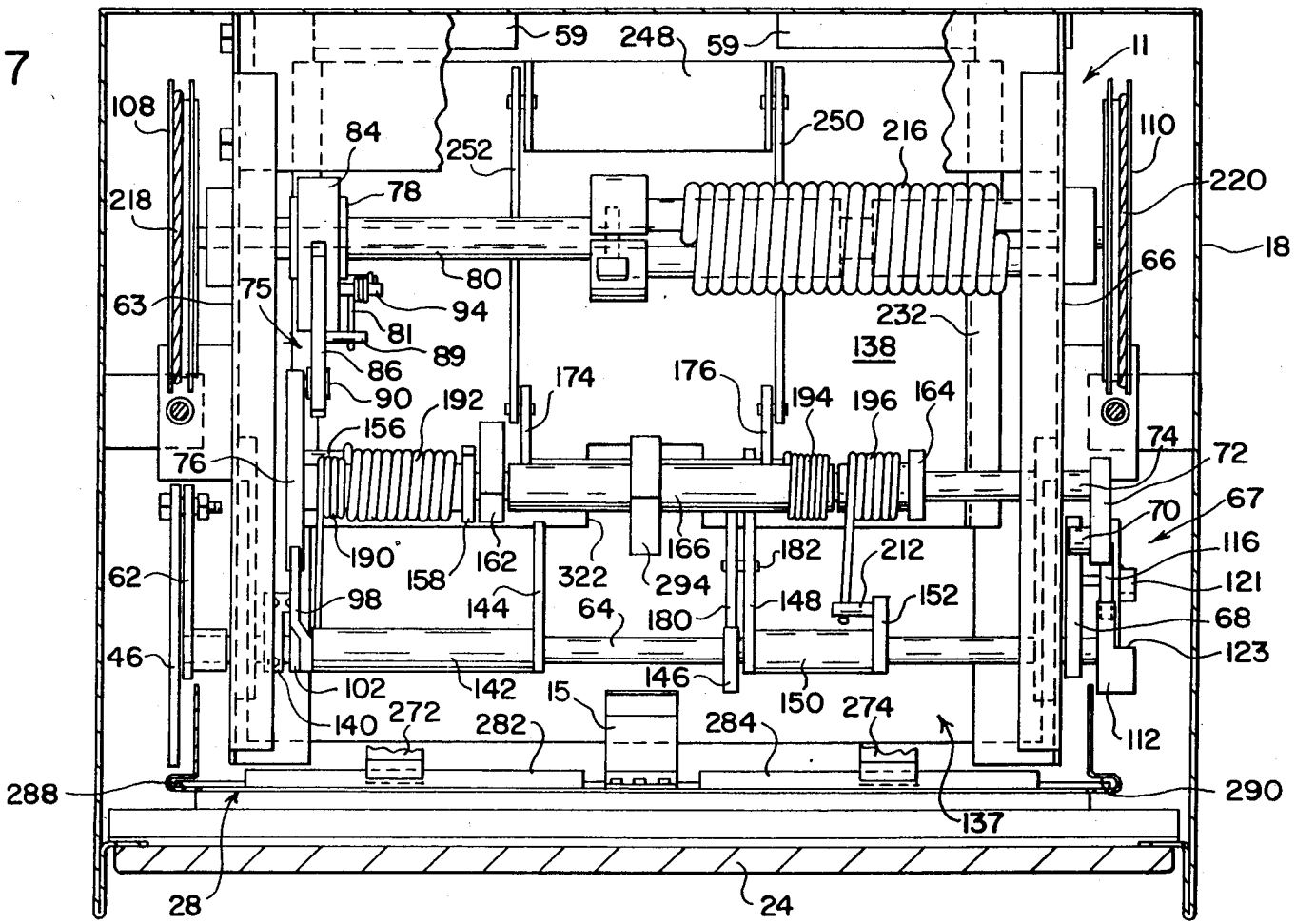
FIG. 7 is a plan view, partially in section, of the mechanism shown in FIG. 4.

It will be observed that connecting member 46, the lower end of which was first noted in FIG. 1, has an upper end pivotally secured to a crank arm 62 which is rigidly keyed to a front shaft 64. Front shaft 64 is mounted for arcuate movement between module side panel members 63 and 66. A bell shaped timing cam 68 is freely mounted on the opposite or right hand outboard end of front shaft 64. A cam follower 70 is rotatably mounted on a cam follower supporting block 72 which is in turn rigidly secured to intermediate shaft 74. Intermediate shaft 74 is also journaled for arcuate movement between module side panels 63 and 66. A clutch rocker arm 76, FIG. 5, is freely mounted on the left end portion of intermediate shaft 74 and a clutch collar 78 is rigidly keyed to back shaft 80. A U-shaped or bifurcated sleeve 84, see FIG. 6, is freely fitted on clutch collar 78 to pivotally support one end of a clutch plate 86. Plate 86 is mounted on pin 94, journaled in the bifurcated ends of sleeve 84. A drive pin 90 is carried on clutch rocker arm 76 for driving engagement with slot 88 of clutch plate 86.

From the foregoing it can be seen that the energy source for operating the dispensing mechanism derives from the act of opening the cabinet outer door 24. This act causes connecting link 46 and crank arm 62 to rotate front shaft 64 in a clockwise direction as depicted in FIG. 5. On the right outboard end of front shaft 64, as seen in FIG. 4, timing cam 68, by transmission means 67, yet to be described, lifts cam follower 70 and cam follower supporting block 72, rigidly keyed to the right outboard end of intermediate shaft 74. The lifting of cam follower 70 and cam follower supporting block 72 causes intermediate shaft 74 to rotate counterclockwise. As intermediate shaft 74 rotates counterclockwise, clutch assembly 75 causes back shaft 80 to rotate clockwise. Thus, as shown in FIG. 5, energy imparted to front shaft 64 is transmitted from left to right along front shaft 64, and from front shaft 64 over to intermediate shaft 74 by means of the transmission sub-assembly 67 comprising in part cam 68, cam follower 70 and cam follower supporting block 72. Counterclockwise rotation of intermediate shaft 74 transmits energy from right to left along intermediate shaft 74 over to back shaft 80 by clutch assembly 75.

Figure 12:
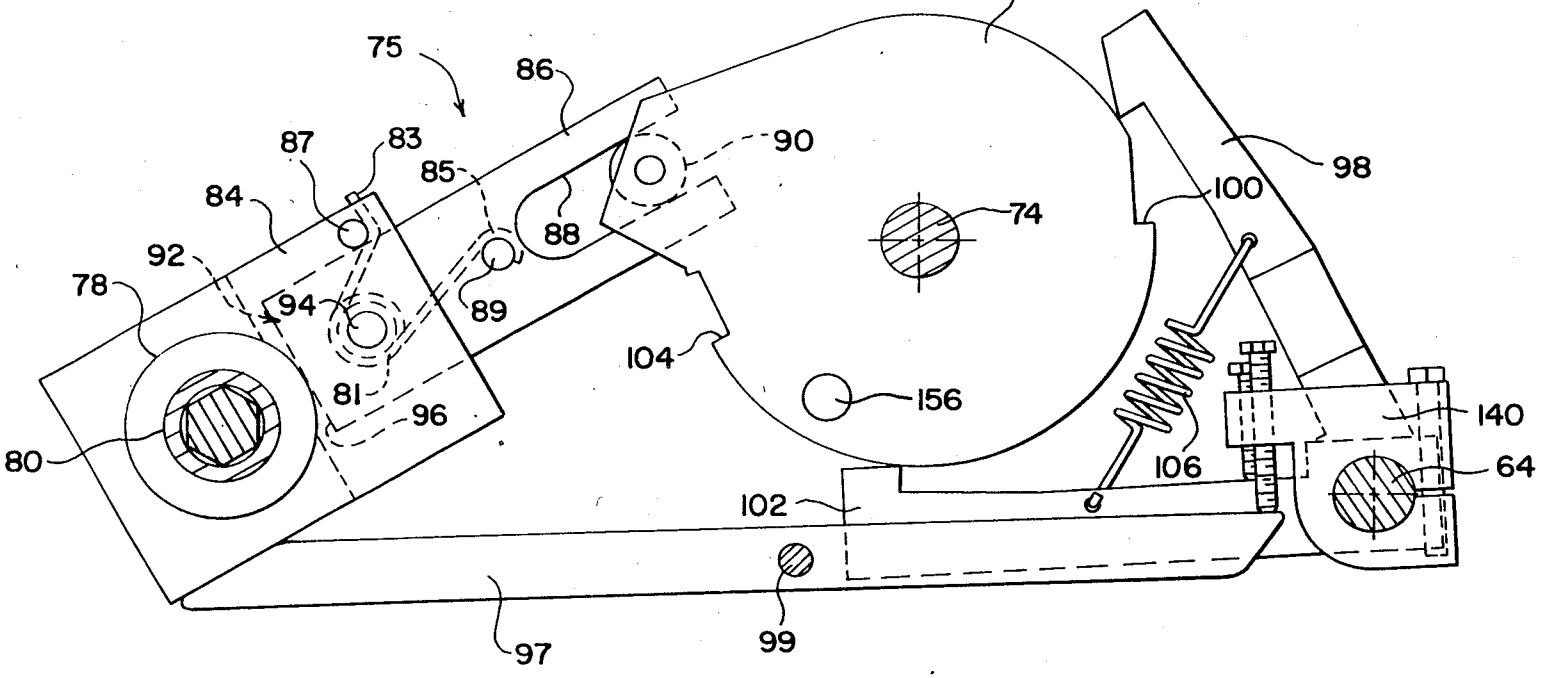
FIG. 12 is a left side elevational view of the intermediate to rear shaft clutch assembly sub-combination shown in the clutch disengaged position.

It will be observed from FIG. 12 that the lower end 92 of clutch plate 86 is tangential with clutch collar 78. It will also be observed from FIG. 12 that upon counterclockwise rotation of intermediate shaft 74, drive pin 90 rotates clutch plate 86 about its pivotal pin 94 to bring lower edge 96 into biting or gripping contact with clutch collar 78. It follows, that by applying rotation stop means 97 to bifurcated sleeve 84, with clockwise rotation of intermediate shaft 74, pin 90 will counterrotate clutch plate 86 to relieve the pressure contact between clutch collar 78 and clutch plate end 96. Rotation of clutch plate 86, after gripping engagement is made between lower end 96 and clutch collar 78, rotates clutch collar 78 and back shaft 80 until counterclockwise rotation of rocker arm 76 is arrested by pawl 98 which engages tooth 100 of rocker arm 76. Pawls 98 and 102 are biased into tooth engagement by spring 106 having opposite ends hooked to pawls 98 and 102 respectively. The outboard ends of back shaft 80 are journaled for arcuate movement between module side panels 63 and 66 and carry thereon a pair of newspaper elevator platform pulleys 108 and 110 outboard of panels 63 and 66.

The Power Train Transmission

Reference is now made to FIGS. 4, 6 and 8–11. The transmission 67 comprises a sub-combination of parts, interposed between front shaft 64 and intermediate shaft 74, which serve to selectively transmit driving power from front shaft 64 to back shaft 74 in a particular prescribed manner for the proper functioning of the mechanism.

Figure 8:
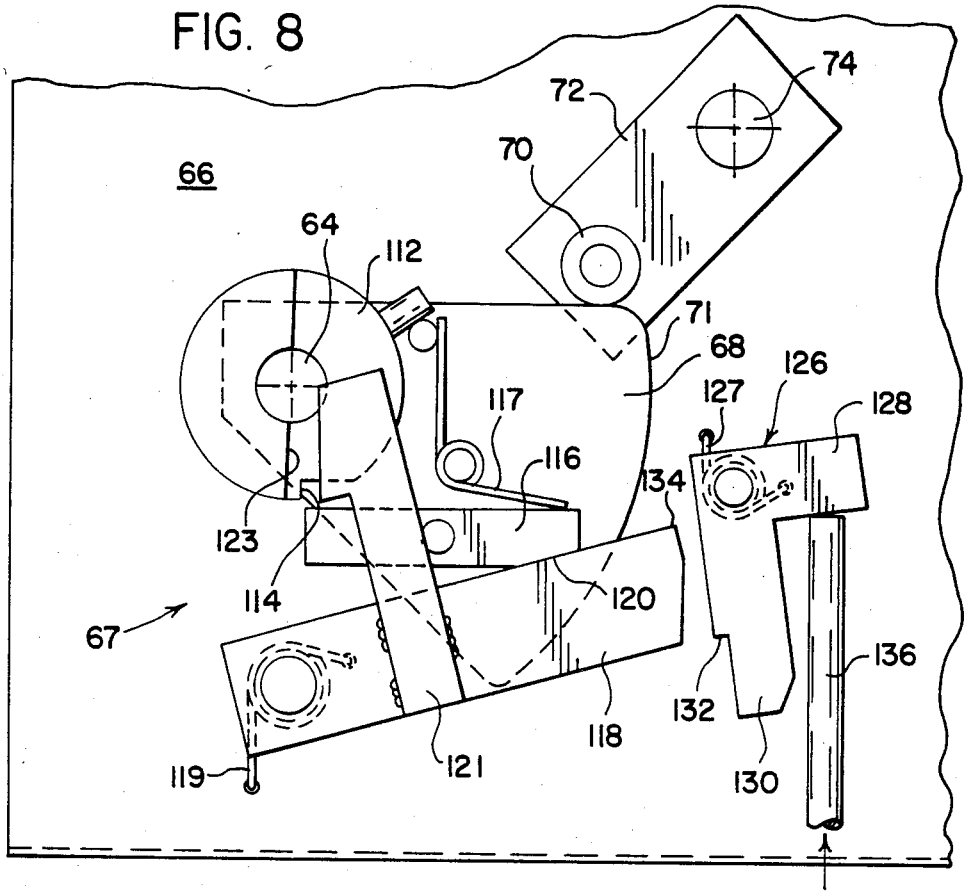
FIG. 8 is a right side elevational view of the front to intermediate shaft power transmission assembly sub-combination shown in the neutral "ready to load" position.

Referring first to FIG. 8, therein is shown a single tooth flange 112 having a tooth 114. Flange 112 is rigidly keyed to front shaft 64 and bell-shaped timing cam 68 is freely mounted on front shaft 64. A timing cam drive pawl 116 is pivotally mounted on cam 68 and biased by spring 117 to make engagement with tooth 114. A latching arm 118 is pivotally secured to frame member 66 and is biased by spring 119 into contact with timing cam drive pawl 116 along interface 120. A latching arm reset cam follower 121 is upstanding from and rigidly fixed to latching arm 118. A reset cam 123 is secured to flange 112 to engage cam follower 121, when in the position shown in FIG. 8, and to rotate latching arm 118 downwardly into the position shown in FIG. 9. A bell crank 126, provided with arms 128 and 130, is pivotally secured to module side panel 66 and is urged by spring 127 from its position shown in FIG. 8 into latching engagement as shown in FIG. 9, with latching arm 118 by means of notch 132 of bell crank 126 and upper corner 134 of latching arm 118.

Figure 9:
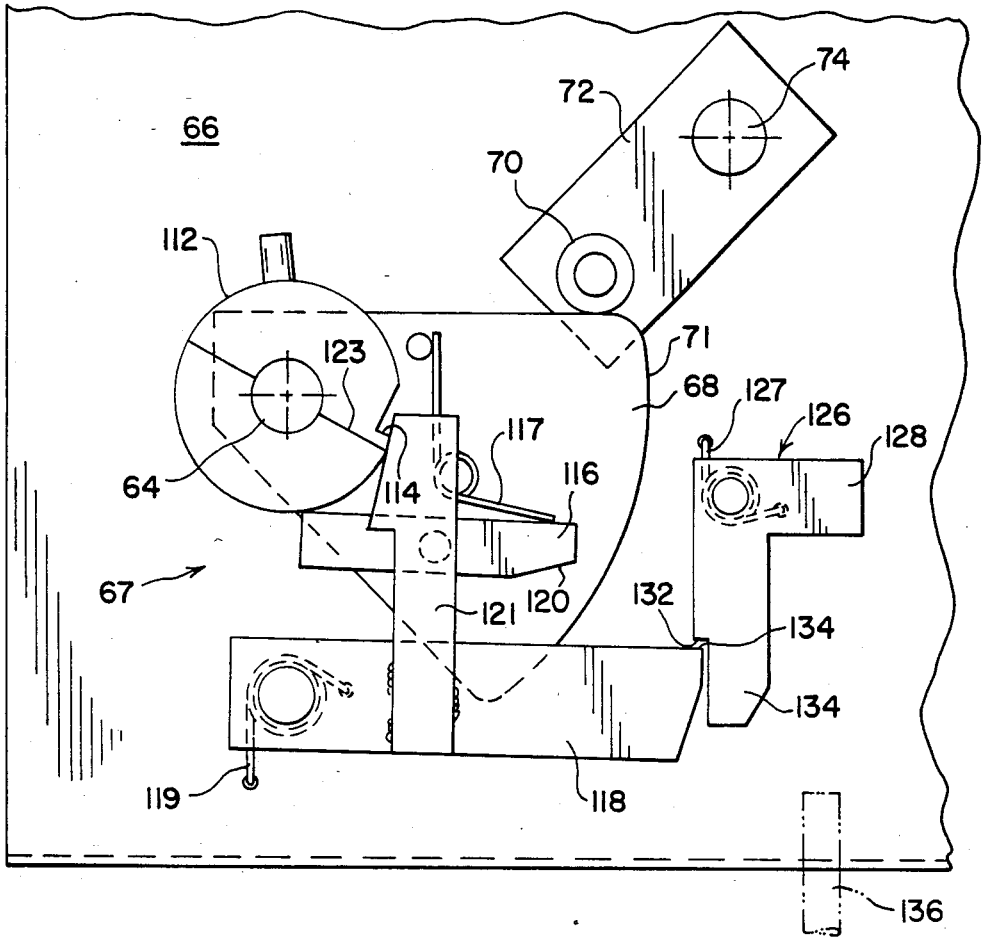
FIG. 9 is a right side elevational view of the front to intermediate shaft power transmission assembly sub-combination shown in the neutral "fully loaded"position.

During initial counterclockwise rotation of front shaft 64, as shown in FIG. 9, tooth 114 of single tooth flange 112 overrides the upper surface of timing cam drive pawl 116 and therefore transmits no movement to timing cam 68. As a consequence, cam 68 and cam follower 70 remain stationary and no rotation of intermediate shaft 74 is accomplished. However, since cam 123 and cam follower 121 have rotated latch 118 into latching engagement with bell crank 126 cam drive pawl 116 is freed from the influence of latch 118. Thus, when flange 112 is next counter-rotated, drive pawl 116 is positioned to engage tooth 114 and the relationship of parts becomes as shown in FIG. 10.

Figure 11:
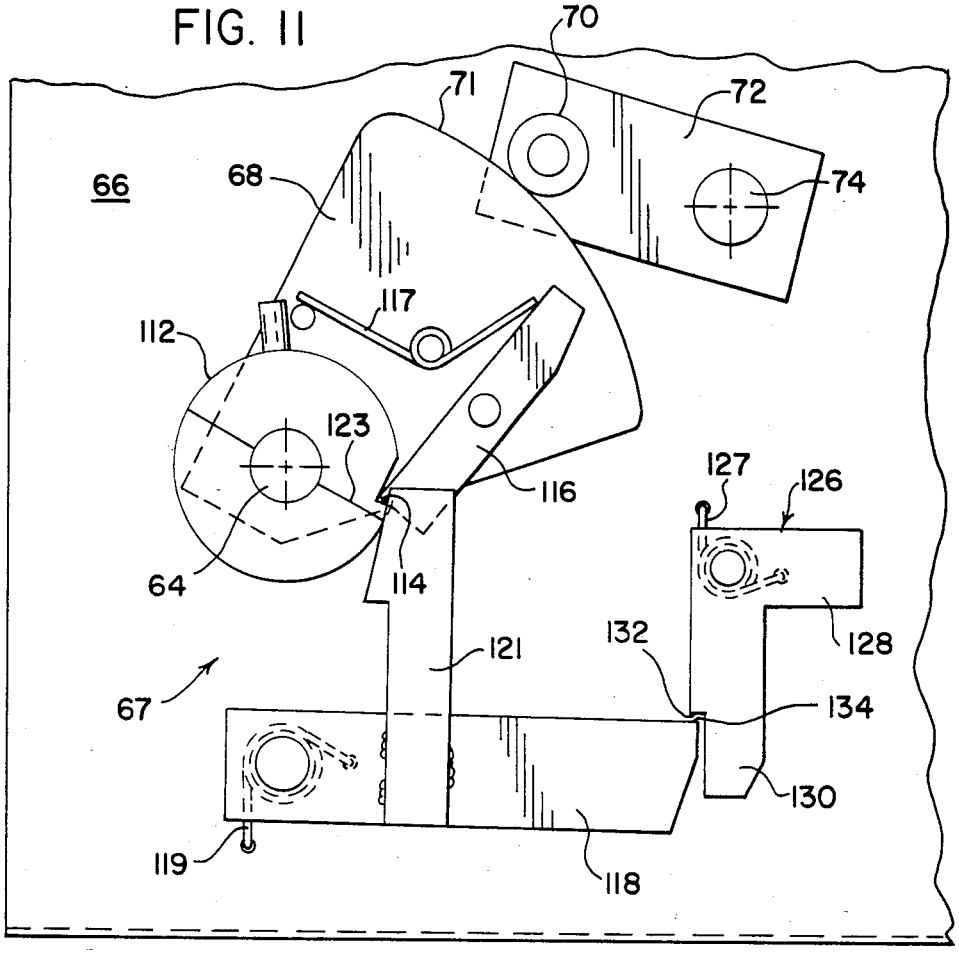
FIG. 11 is a right side elevational view of the front to intermediate shaft power transmission assembly sub-combination shown in the "newspaper dispensed" position.

Referring now to FIG. 11, the next following counterclockwise rotation of front shaft 64 will bring tooth 114 of flange 112 into driving contact with timing cam drive pawl 116. As flange 112 continues to turn, timing cam 68 will be pivoted to lift cam follower 70. Cam follower 121, having now been rotated into the vertical position shown in FIG. 11, can no longer be acted upon by cam 123, and latching arm 118, therefore, continues in latched engagement with bell crank 126.

Figure 10:
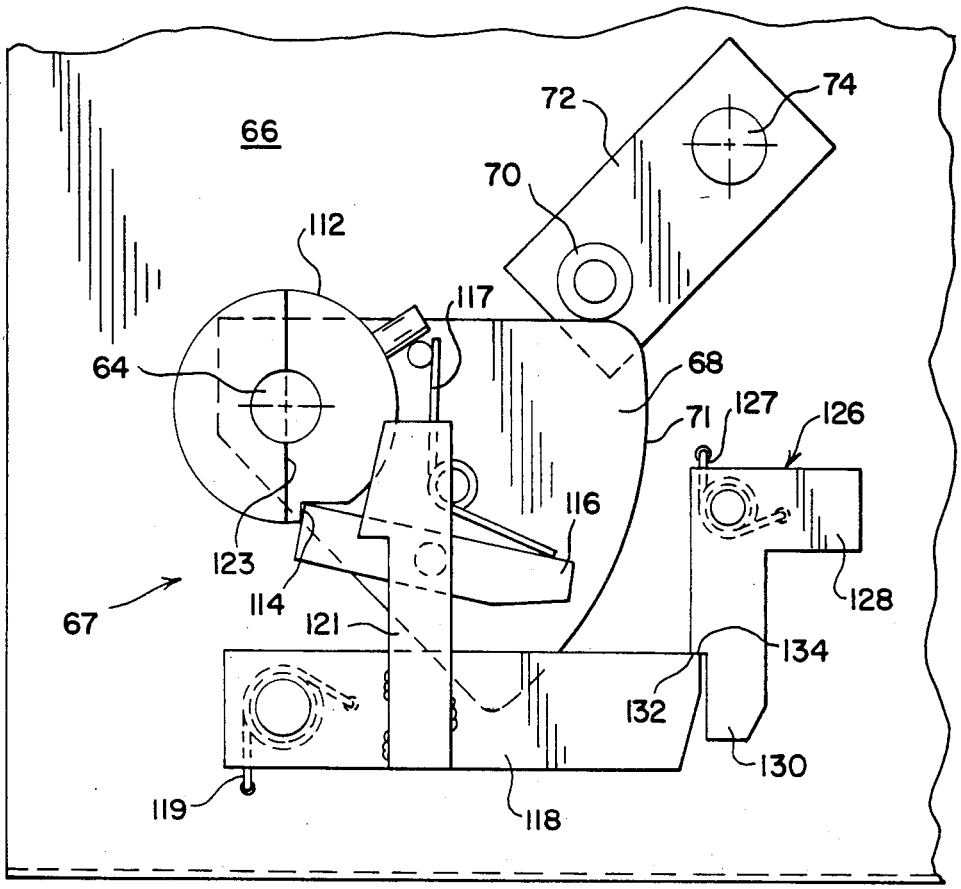
FIG. 10 is a right side elevational view of the front to intermediate shaft power transmission assembly sub-combination shown in the drive "start to dispense" position.

With the transmission just described, and as shown in FIGS. 1–11, it will be understood that this mechanism will permit an initial opening of the outer door 24 to load the cabinet 12 with a vertical stack of newspapers without actuating the dispensing mechanism controlled by the intermediate shaft 74 and the back shaft 80. The transmission 67 may, therefore, be characterized at this time as being in neutral, as shown in FIGS. 8 and 9. However, the act of initially opening the outer door 24 shifts the transmission 67 from neutral to drive, as shown in FIGS. 10 and 11. The transmission 67 will remain in drive until the last newspaper has been dispensed from the newspaper elevator platform 137, FIG. 4. At this time a probe 136, upstanding from platform 137, will contact arm 128 of bell crank 126 to pivot bell crank 126 out of latching engagement with latch arm 118. Latch arm 118 is then free to pivot upwardly, knocking drive pawl 116 out of engagement with tooth 114 of flange 112. With flange 112 decommissioned, the cabinet 12 is again in readiness to be reloaded.

The Clutch Mechanism

The clutch mechanism 75, disclosed in FIGS. 4–6 and 12–14, is of the overrunning type wherein it will permit back shaft 80 to freely rotate when, for instance, the newspaper platform 138 is being lowered for loading, but will automatically clutch back shaft 80 against counterrotation unless positively declutched. Referring first to FIG. 6, therein is shown a clutch rocker arm 76 freely mounted on intermediate shaft 74. A back shaft clutch collar 78 is rigidly keyed to back shaft 80 and a bifurcated sleeve 84 is concentrically fitted about collar 78 to freely pivot thereon. A rectangular clutch plate 86 is pivotally secured at one end portion 92 between the bifurcated portions of sleeve 84 on pin 94, FIG. 12. The other end portion of clutch plate 86 is provided with an elongated slot 88 adapted to receive clutch rocker arm drive pin 90. Spring means 81, mounted on pin 94, have ends 83 and 85 anchored on pins 87 and 89, respectively. Since pin 87 is secured to bifurcated sleeve 84 and pin 89 is secured to clutch plate 86, spring 81 acts to engage the lower end face 96 of clutch plate 86 for clutching engagement with clutch collar 78. Although clutch rocker arm 76 is freely mounted on intermediate shaft 74 it is coupled to intermediate shaft 74 and resiliently driven to rotate therewith by a clutch rocker arm drive spring 192. This resilient drive is more fully explained in the following section on operation of the invention.

Referring again to FIG. 6, when clutch rocker arm 76 is rotated clockwise by drive spring 192, rocker arm pin 90 pivots clutch plate 86 about pivot pin 94. End 96 of clutch plate 86, FIG. 12, therefore, is rotated into clutching engagement with clutch collar 78. Back shaft 80 may then be rotated until arrested by engagement of upper rocker arm pawl 98 with ratchet tooth 100 of rocker arm 76, FIG. 13. A lower rocker arm pawl 102 is adapted to engage ratchet tooth 104 during a subsequent rotation of rocker arm 76, as will be explained in the section on operation of the invention. Upper and lower pawls 98 and 102 are urged by spring 106 into engagement with their respective ratchet teeth 100 and 104, respectively. Upper pawl 98 is disengaged from ratchet tooth 100 by a release arm 144, FIG. 5, and lower pawl 102 is released from ratchet tooth 104 by release arm 140. An overrunning clutch release spring 190, FIG. 6, is adopted to counter-rotate clutch rocker arm 76, which, in conjunction with bifurcated sleeve stop 97, releases clutching engagement of back shaft 80, as will be more fully explained hereinafter.

Newspaper Dispensing Mechanism

Referring now to FIGS. 4–7, the component parts mounted on the front, intermediate and back shafts will be discussed in this stated order.

Viewing front shaft 64 from left to right in FIG. 5, upper pawl 98 is interconnected with upper pawl release arm 144 by a connecting sleeve 142, freely fitted about front shaft 64. Spaced to the right of upper pawl release arm 144, a dispenser release cam 146 is keyed to front shaft 64 for camming engagement with dispenser release lever 180. Dispenser release lever 180 is pivotally mounted on pin 182 carried by release pawl 148. When front shaft 64 is rotated clockwise, dispenser release cam 146 is rotated to depress dispenser release lever 180 and dispenser release pawl 148. Dispenser release pawl 148 is interconnected with dispenser return spring anchor arm 152 by a connecting sleeve 150, freely fitted about front shaft 64. The bell shaped timing cam 68, freely fitted on the right outboard end of front shaft 64 has already been discussed with respect to the transmission 67 which selectively drivingly interconnects front shaft 64 with intermediate shaft 74.

Viewing intermediate shaft 74 from left to right, overrunning clutch release spring 190 and clutch drive spring 192 have already been identified in the foregoing discussion of the clutch assembly 75. Springs 190 and 192 are freely fitted about intermediate shaft 74 but their ends are anchored in such a manner as to enable the springs to store and to release energy as required. A pin 156, FIG. 6, projects inwardly and horizontally from clutch rocker arm 76. Another pin 160, FIG. 4, extends horizontally from both sides of a rectangular flange 158 which is freely fitted on intermediate shaft 74. Pins 156 and 160 are positioned the same radial distance from the intermediate shaft 74 centerline so as to provide intended interference therebetween, as will be explained hereinafter. End 198 of spring 190 is anchored to sleeve 142 whereas opposite end 200 is anchored to pin 160. End 202 of spring 192 is anchored to pin 160 and the opposite end 204 is anchored to pin 156, FIG. 6.

To the right and adjacent the flange 158, FIG. 5, is a crank arm 162 keyed to intermediate shaft 74 for the purpose of driving flange 158. A sleeve 166 and a crank arm collar 168 concentrically encase the portion of the intermediate shaft 74 between crank arm 162 and crank arm 164 to provide stabilizing support for dispenser actuator spring 194 and dispenser return spring 196. Sleeve 166 also supports a pair of depending dispenser platen drive arms 174 and 176. A cross rod 178 interconnects drive arms 174 and 176 and is parallel to sleeve 166. A pin 186 projects horizontally inwardly from crank arm 164 and a pin 212 projects horizontally inwardly from anchor arm 152 on front shaft 64. End 206 of spring 194 is anchored on pin 186 and opposite end 208 is anchored on a portion of cross rod 178 extending to the left of drive arm 176 as seen in FIG. 6. End 210 of spring 196, FIG. 5, is anchored on pin 212 and opposite end 214 is anchored on pin 186.

Figure 15:
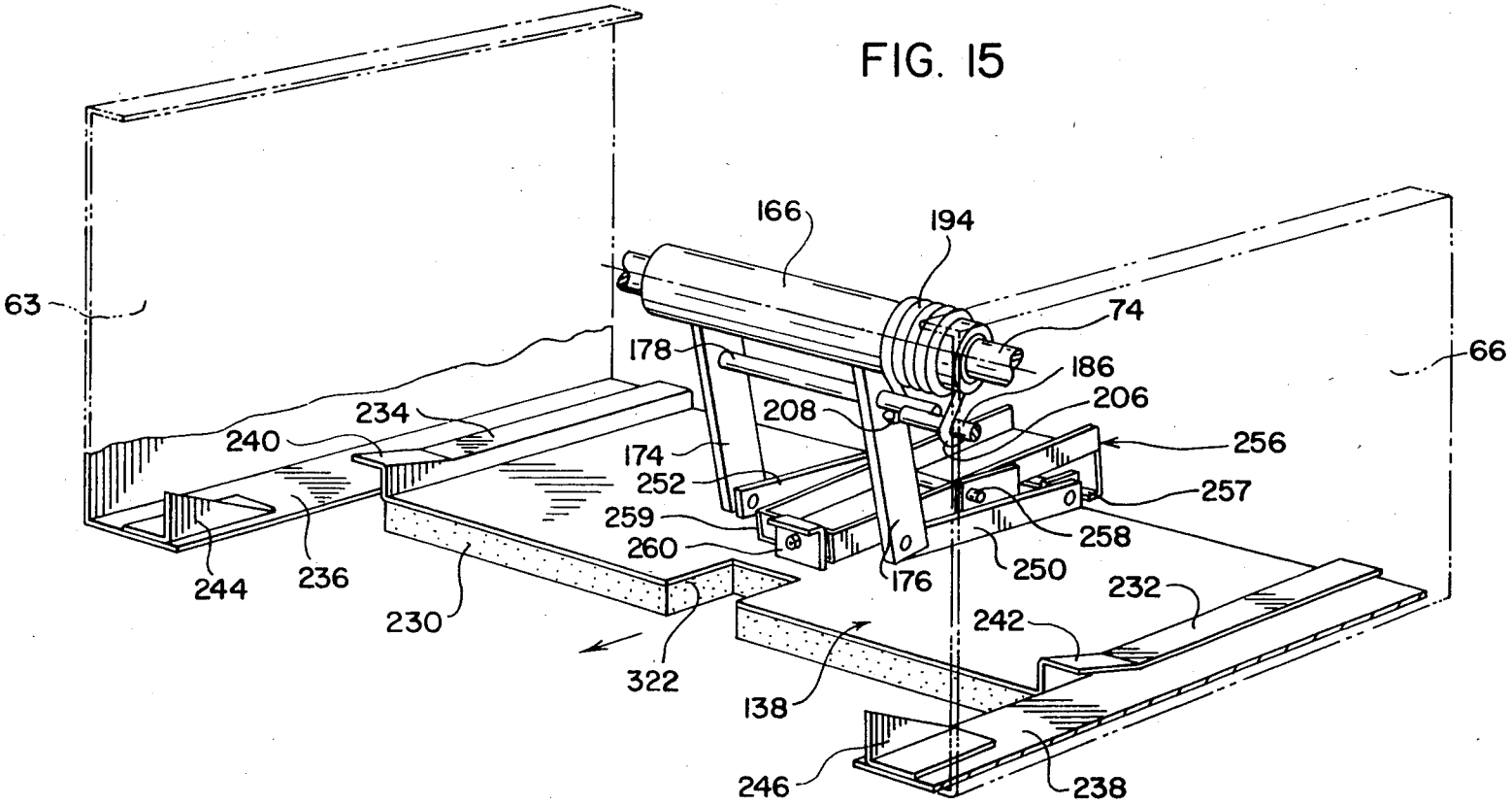
FIG. 15 is a fragmentary perspective view of the newspaper dispensing platen assembly sub-combination.

The newspaper dispensing platen sub-assembly is shown in FIGS. 4 and 15. Dispensing platen 138 is provided on its underside with a resilient pad 230, such as polyurethane foam. Side runners 232 and 234 are formed on the edges of platen 138 to ride on rails 238 and 236, respectively, of module side panels 63 and 66.

The leading ends 240 and 242 of runners 234, 232, respectively, are flared to ride up on inclined wedges 244 and 246, respectively. A U-shaped bracket 248. FIG. 6, is secured along the back edge of the top surface of the dispensing platen 138 for pivotally mounting the rear ends of drag links 250 and 252. The forward ends of drag links 250 and 252, FIG. 15, are pivotally secured to the lower ends of drive arms 176 and 174, respectively.

A second U-shaped bracket 254, FIG. 6, is positioned forward of the first U-shaped bracket 248 and is also secured to the top surface of the dispensing platen 138 between drag links 250 and 252. A newspaper hook means 256 is pivotally mounted, longitudinally off center, on rod 258 in U-shaped bracket 254 so as to shift hook 257 into an upper position, as shown in FIG. 6. As eccentric plate 260 is rotated counterclockwise, as shown in FIG. 6, the front end 259 of hook 256 is elevated to lower the hook portion 257 below the lower surface of the polyurethane pad 230. Normally, hook means 256 is in the raised position, as shown, to incapacitate hook 257. However, the hook is lowered to assist in dispensing exceptionally bulky newspapers such as metropolitan Sunday editions. In which case, the hook 257 is lowered just enough to engage approximately one-third of the upper trailing edges of the newspaper.

When drive arms 174 and 176 are swept toward the front of the cabinet 12, drag links 250 and 252, acting on U-shaped bracket 248, cause dispensing platen 138 to also move forward. No downward pressure is exerted on dispensing platen 138 by drive arms 174 and 176, since in a preferred embodiment of the invention, the weight of the platen 138 provides sufficient downward force on the top newspaper to provide the requisite frictional bond between the platen and the top newspaper for dispensing purposes. In the preferred embodiment of the invention, the platen plus the actuating hardware mounted thereon, weighs approximately two pounds. This is sufficient for most of the heaviest as well as lightest newspapers presently being sold in vending machines in the United States. The range of newspaper weights which the invention can reliably dispense with a two pound dispensing platen is approximately from five to fifty ounces.

The Cover Plate Mechanism

Figure 16:
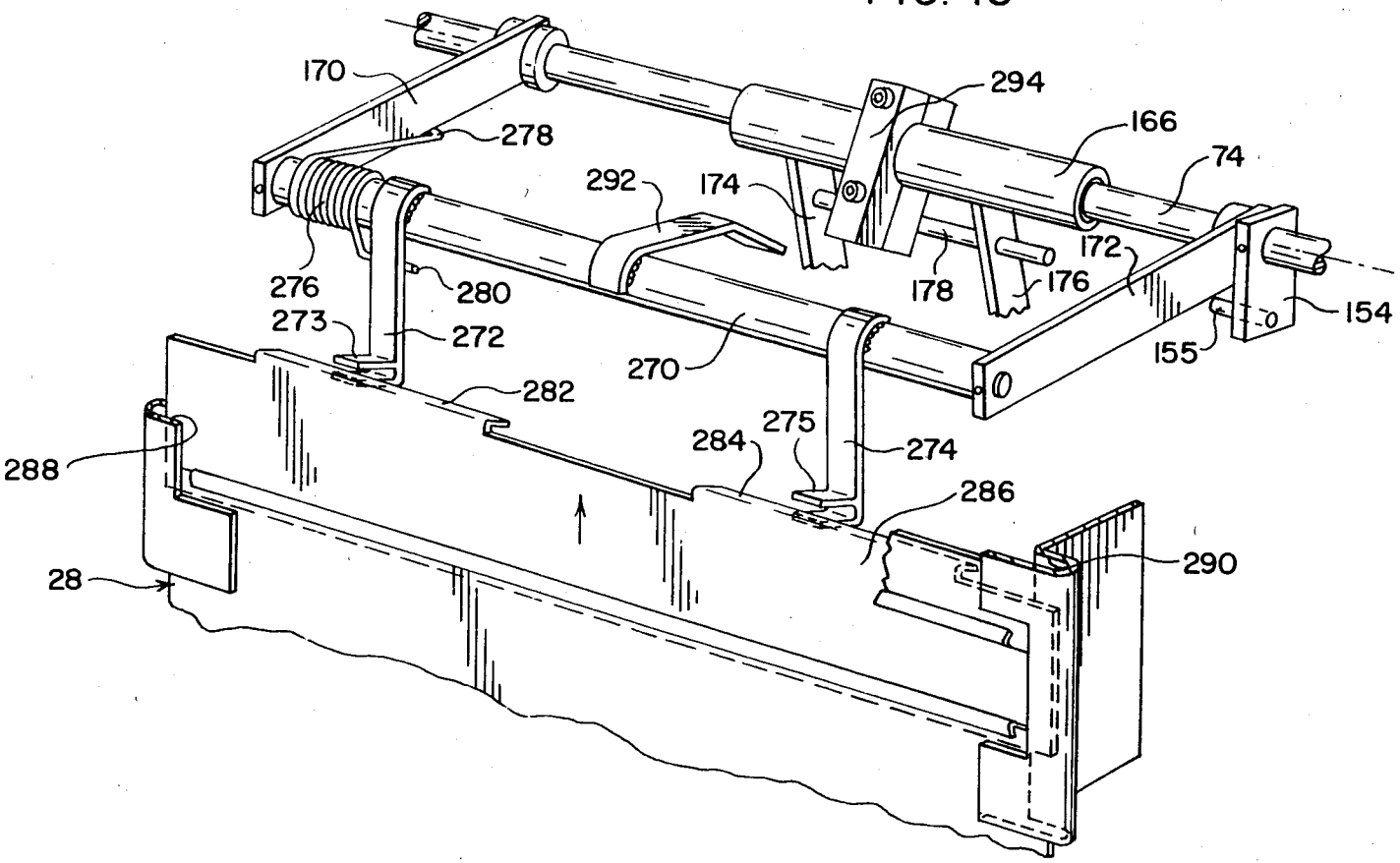
FIG. 16 is a fragmentary perspective view of a preferred slot cover plate actuating assembly sub-combination; and, FIG. 17 is a fragmentary elevational view, in section, of a slot cover plate used in another preferred embodiment of the invention.

Reference is made to FIG. 16. Previously identified arms 170 and 172 are freely mounted on intermediate shaft 74 and extend forward toward the front of the cabinet 12. A cross rod 270 extends freely between and interconnects the free ends of arms 170 and 172. A pair of cover plate forked hooks 272 and 274 are rigidly secured to cross rod 270. Biasing spring 276 is fitted about cross rod 270, with one end 278 anchored on the underside of arm 170 and the other end 280 anchored behind hook 272 to urge hooks 272 and 274 into forked engagement with the cover plate flanges 282 and 284 of cover plate 286. Cover plate 286 is adapted to be shifted vertically in channel portions 288 and 290 of access door 28 by crank arm 154 and crank arm pin 155 rigidly mounted on intermediate shaft 74. By mounting crank arm 154 on intermediate shaft 74, the cover plate 286 will not be unnecessarily raised or lowered during the loading operation. Lost motion is provided between crank arm 154 and arm 172 because only a small arcuate movement of intermediate shaft 74 is required to raise and lower cover plate 286.

A rearward extending lever 292 is rigidly secured to cross rod 270. Lever actuating bracket 294 is rigidly clamped to sleeve 166 and adapted to contact the underside of lever 292 after cross rod 270 has been lifted and rotated rearwardly and after dispenser platen drive arms 174 and 176 are triggered to rotate forwardly. Bracket 294 then rotates lever 292 counterclockwise, which shifts hooks 272 and 274 from under flanges 282 and 284, respectively, thereby permitting cover plate 286 to vertically drop within the confines of channel portions 288 and 290.

Display Door Mechanism

Reference is made to FIGS. 4, 8 and 9. After the last newspaper has been dispensed from the elevator platform 137, probe 136, FIG. 8, strikes arm 128 of bell crank 126, thereby pivoting arm 130 out of latching engagement with latch 118. Latch 118 is then spring urged upwardly by spring 119. Wire 41, FIG. 4, is encased in a first flexible cable 42, which is anchored at one end 45 to side panel 66 and at its opposite end to latch 118. When latch 118 pivots upwardly, the cable 42 and the wire 41 encased within must also move upwardly with latch 118. Movement of wire 41 upwardly withdraws door latch 38, FIG. 1, from keeper 40 to permit inner door 26 to be opened by spring 34. Latch 118, is reset with bell crank 128 upon the next opening of outer door 24, as previously described in the Transmission Mechanism section of this specification. When latch 118 is reset, latch 38 is released by wire 41 to re-engage latch keeper plate 40 upon the closing of the inner door 26. From latch 38 to latch 118, wire 41 is protectively encased in a second flexible cable 43 with one end anchored on outer door 24 and the other end anchored on bracket 51 secured to side panel 66.

As aforesaid, inner door 26 will only become unlatched after the last newspaper has been dispensed from the elevator platform 137. In the event that one or more unsold papers are still on the platform 137 when copies of the next edition are to be loaded, inner door 26 will not be in an unlatched condition. In this event, in order for the newspaper delivery-man to insert a display copy in the display compartment 56, he will depress latch release lever 47, FIG. 4, pivotally mounted on side panel 66. Wire 41 is secured at one end to latch release lever 47 and at its opposite end to inner door latch 38. Thus, when latch release lever 47 is depressed, wire 41 shifts to cause inner door latch 38 to be withdrawn from latch plate 40, thereby releasing inner door 26. Upon release of lever 47, since latch 38 is spring urged into engagement with latch plate 40, latch 38 and latch plate 40 will relatch when inner door 26 is closed against outer door 24. This may be done either manually by the delivery-man before closing the outer door 24 or merely by the act of closing the outer door 24. In the latter case, inner door 26 will relatch when sandwiched between the outer door 24 and the access panel 28.

Operation

The invention is adapted to provide two cycles of operation. During the first cycle, the dispensing drive transmission 67 is in neutral. Outer door 24 and inner door 26 are opened and a display newspaper is placed in the compartment 37 formed by the outer and inner doors. Optionally, the inner door may then be closed. The newspaper elevator platform 137 is lowered and newspapers are loaded on the elevator platform. The outer door is then closed and the platform is elevated until the top newspaper is approximately in horizontal alignment with dispensing slot 52. All of these operations take place without triggering the newspaper dispensing mechanism because the transmission is in neutral.

The second cycle of operation is phased in when the outer door 24 is first opened and the dispensing mechanism transmission is engaged in the drive position to continuously operate the dispensing mechanism upon subsequent outer door openings thereafter so long as newspapers remain on the elevator platform. Predetermined mechanical movement of parts repetitively take place in the dispensing mechanism at various positions of arcuate shift of the outer door 24 when the outer door is reopened after loading. Essentially, each opening of the outer door, after loading, tensions the drive springs in the dispensing mechanism; lowers the newspaper elevator platform a first time; raises the dispensing slot cover plate; triggers the dispensing platen to dispense a newspaper; lowers the newspaper platform a second time; lowers the cover plate; returns the dispensing platen to its initial position in readiness for the next dispensing operation; and raises the newspaper elevator platform sufficiently to position the next newspaper to be dispensed.

Detailed reference will now be made to the specific drawings and sub-combination of parts shown therein which coact in timed sequence to perform a newspaper dispensing function in accordance with a preferred embodiment of the invention.

The Loading Cycle

Reference is made to FIGS. 1, 4, 8 and 9. When it is time to reload the cabinet 12 with the next edition of newspapers, one of two conditions will exist. Either the earlier edition has been sold out or some unsold newspapers are still on the elevating platform. The sold out condition will be discussed first.

(a) Loading an Empty Cabinet

When the last newspaper has been sold, probe 136, FIG. 8, will disengage bell crank 126 from latch 118. Since latch 118 is spring biased to pivot upwardly counterclockwise upon release from bell crank 126, it simultaneously performs two functions. The first function is to release inner door latch 38, as described in the preceding section. The second function is to shift the transmission 67 into neutral. This is accomplished when counterclockwise pivoting latch 118 also pivots cam drive pawl 116 counterclockwise out of engagement with toothed drive flange 112. When toothed drive flange 112 and cam drive arm 116 disengage no motion can be transmitted from front drive shaft 64 to intermediate drive shaft 74. This is the condition of the transmission prior to reloading a sold out retro-fitted newspaper vending machine.

As the deliveryman opens the outer door 24, the inner door 26, having been previously unlatched, will spring open. Lever 44, connecting rod 46 and crank arm 62 coact to rotate front shaft 64. Toothed flange 112 is rotated but overrides depressed cam drive pawl 116, FIGS. 8 and 9. Cam 123, mounted on flange 112 engages cam follower arm 121 and urges it arcuately rearwardly and latch 118 arcuately downwardly into latching engagement with bell crank 126. Cam drive pawl 116 is then released into position to re-engage tooth 114 upon the next outer door opening. Transmission 67 has now been shifted from neutral to drive in readiness to actuate the dispenser upon completion of loading.

After opening the outer door 24, the newspaper deliveryman places a display newspaper copy in the display compartment 37 and closes the inner door 26. He next unlocks the access panel 28 and lowers it to a horizontal position over the outer door 24. By reaching into the opening created by lowering the access panel 28, the deliveryman places his hands on the newspaper elevator platform 137 and forces it as far down as necessary to accommodate a new stack of newspapers. Since clutch assembly 75 is of the overrunning type, the back shaft 80 is free to rotate in a direction permitting lowering of the platform. At the same time, back shaft elevator platform spring 216 is being tensioned to raise the platform 137 when back shaft 80 is declutched. Simultaneously, pretensioned clutch spring 81 urges clutch rocker arm 76 and clutch plate 86 into clutching engagement with clutch collar 78. When so engaged, clutch assembly 75 prevents counter-rotation of back shaft 80 to raise platform 137.

Newspapers are next vertically stacked on the elevator platform 137, with folded edges toward the front of the cabinet 12, access panel 28 is repositioned and locked and outer door 24 is closed and latched. The closing of outer door 24 counter-rotates front shaft 64 and rotates release arm 140 into contact with clutch release stop 97 and lower pawl 102. When clutch release stop 97 engages bifurcated sleeve 84, pretensioned overrunning clutch release spring 190 rotates clutch rocker arm 76 and clutch plate 86 out of clutching engagement with clutch collar 78 keyed to back shaft 80. As back shaft 80 is declutched, back shaft platform elevating spring 216 raises the stack of newspapers until the top newspaper is pressed against the undersides of the module side panels 63 and 66. The vending machine 10 is now in condition to sequentially dispense single copies of newspapers.

(b) Loading a Partially Empty Cabinet

If unsold earlier edition newspapers remain on the elevator platform 137, probe 136, FIG. 9, will not be elevated sufficiently to disengage bell crank 126 from latch 118. Thus, inner door latch 38 will not be released from latch keeper plate 40 and inner door 26 will remain closed. Latch release lever 47, FIG. 4, has been provided for this eventuality. The deliveryman will first unlock and open the access panel 28. He then will depress the latch release lever 47, and inner door 26 will spring open. A copy of the late edition is then placed in the display compartment 37. Thereafter, the deliveryman will lower the elevator platform 137 before removing the unsold prior edition newspapers so as not to disengage latch 118 from bell crank 26. After removing the unsold prior edition newspapers, the latest edition newspapers are vertically stacked on elevator platform 137. Access panel 28 is closed and locked and outer door 24 is closed and relatched with the coin actuated latch release box 22. The vending machine 10 is now in readiness to dispense a newspaper the next time outer door 24 is opened.

When only one unsold newspaper remains on the elevator platform, opening of the outer door by the deliveryman will dispense this newspaper. When the door is reclosed, the elevator platform will rise and disengage the transmission 67 and unlatch the inner door 26, see FIG. 8. Therefore, after the cabinet 12 has been reloaded and access panel 28 relocked, and outer door 24 closed, it is necessary for the deliveryman to reopen the outer door 24 one more time in order to reset latch 118 with bell crank 126. The system is then in readiness to dispense newspapers.

The Single Copy Newspaper Dispensing Cycle

Reference is made to FIG. 1. Assuming the cabinet 12 to be preloaded with newspapers, as described in the preceding section, a newspaper purchaser will insert the proper coins in the coin actuated latch release box 22. As with prior art newspaper vending machines, outer door latch 28 is released from latch retainer 30 and door 24 is pulled outwardly and downwardly by the purchaser, as is also standard procedure for prior art honor system type vending machines. However, the opening of outer door 24 of the subject invention provides the energy in a novel manner necessary to drive the mechanism by further tensioning pretensioned drive springs 190, 192, 194 and 196. When the outer door 24 has been opened arcuately about 45°, the cover plate 286 will be raised to fully open dispensing slot 57 and the dispensing module 11 will be triggered to transport a single newspaper a few inches through dispensing slot 52 in access panel 28. The purchaser then grips the leading edge of the dispensed newspaper and pulls the remaining portion through the slot. The outer door 24 will then be closed automatically by spring means. The energy and motion of closing the outer door 24 is sufficient to reset the dispensing module for another dispensing cycle.

Reference is now first made to FIG. 5. Upon opening of outer door 24, clockwise rotation of lower pawl and clutch stop release 140 permits clutch stop 97 to pivot counterclockwise about pin 99 mounted in module side panel 63. Bifurcated sleeve 84 is then freed to pivot about clutch collar 78. Referring to FIG. 10, it will be seen that tooth 114 is in driving engagement with cam drive pawl 116. As flange 112 rotates with front shaft 64, cam drive pawl 116 rotates timing cam 68 counterclockwise about front shaft 64 thereby lifting cam follower 70 until it reaches dwell face 71 of cam 68. As cam follower 70 is lifted, cam follower arm 72, rotates intermediate shaft 74 clockwise, see FIG. 11.

Figure 13:
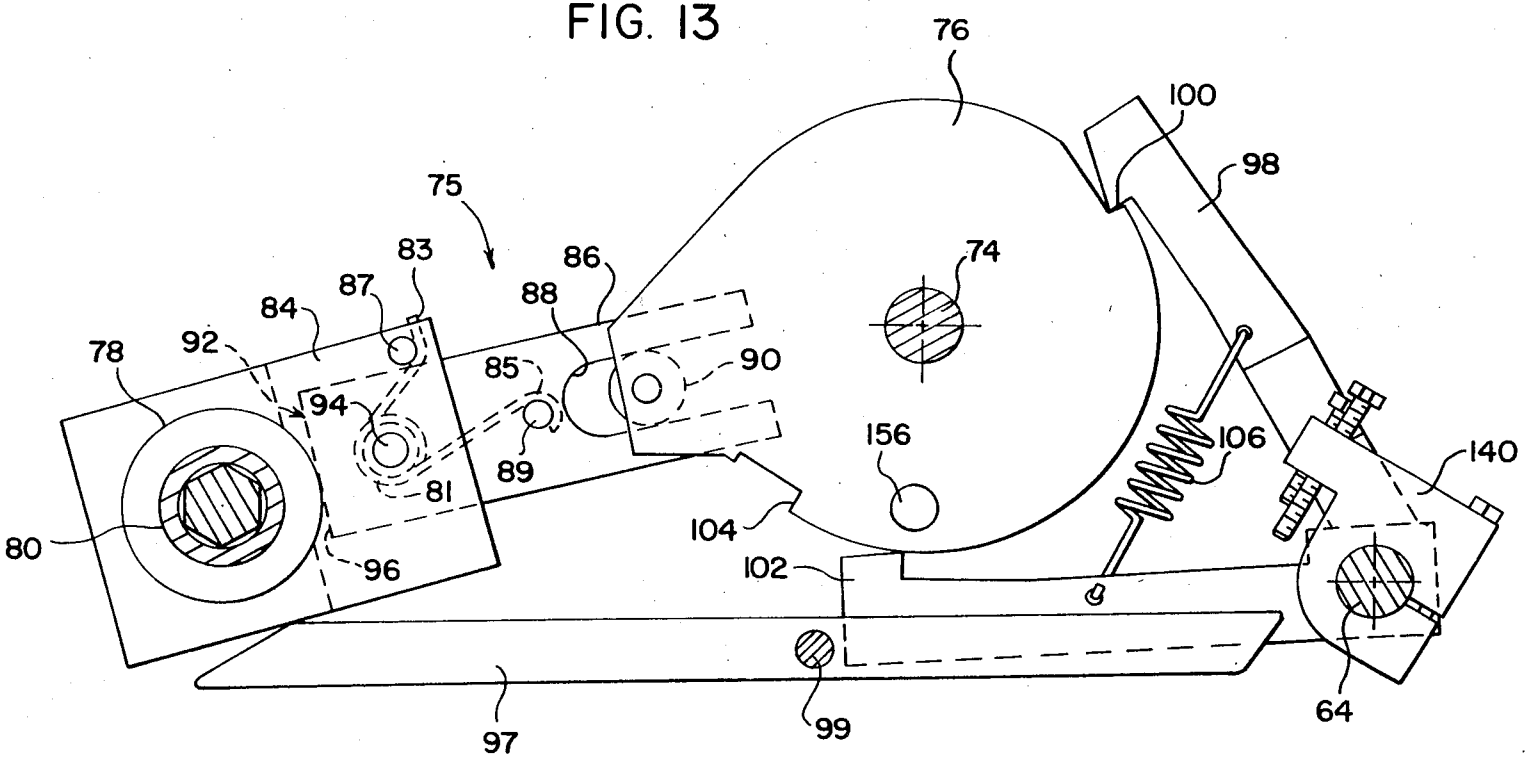
FIG. 13 is a left side elevational view of the clutch assembly shown in FIG. 12, in an intermediate engaged position.
Figure 14:
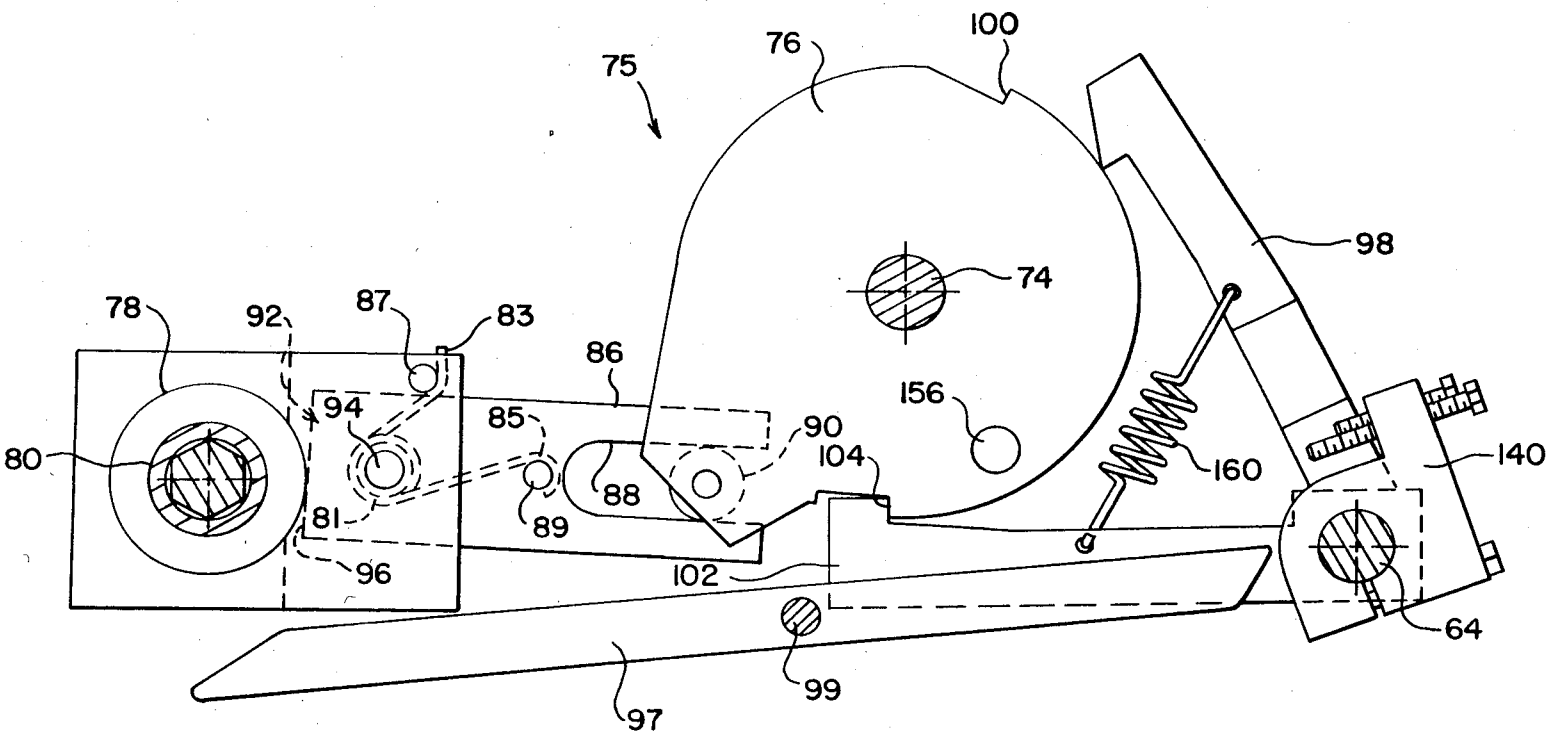
FIG. 14 is an elevational view of the clutch subcombination similar to FIGS. 12 and 13, but shown in the clutch fully rotated and engaged position.

Reference is now made to FIGS. 4, 6, 12, 13 and 14. Referring first to FIG. 4, as intermediate shaft 74 is rotated by cam follower arm 72, crank arm 162 engages and rotates pin 160. Since end 202 of clutch drive spring 192 is attached to and driven by pin 160 and end 204, see FIG. 6, is attached to and drives pin 156, clutch rocker arm 76 is driven clockwise, as shown in FIG. 6, by clutch drive spring 192. Pin 90 rotates clutch plate 86 into clutching engagement with clutch collar 78. Thereafter, as shown in FIG. 13, continued rotation of pin 90 and clutch plate 86 rotates back shaft 80 to lower elevator platform 137 until pawl 98 engages tooth 100 of rocker arm 76. When pawl 98 engages tooth 100 of rocker arm 76, platform 137 has been lowered a sufficient distance to remove the pressure from the top paper, without separating the top paper from the dispenser platen which is adapted to rest or float on the top paper. At this point the outer door 24 has been opened about 20°. After the outer door has been opened approximately another 20°, overrunning clutch release spring 190, dispenser platen drive spring 194 and dispenser platen return spring 196 will have been fully energized, and cover plate 286, FIG. 16, is lifted to uncover slot 52, FIG. 1.

Further opening of outer door 24 about five more degrees rotates dispenser release cam 146 into lever 180 which drives pawl 148 beneath cross rod 178. Cross rod 178 is now released to be driven forward by dispenser drive spring 194. As cross rod 178 moves forward drive arms 174 and 176, FIG. 15, pull drag links 250 and 252 and dispenser platen 138 forward. Because of the high coefficient of friction between the top newspaper and polyurethane pad 230 and the quick acceleration imparted to dispenser platen 138 by drive spring 194, the inertia of the top newspaper is overcome without disturbing the inertia of the second to top newspaper and the frictional bond between the second and third newspapers. Accordingly, the top newspaper is projected through the access panel dispensing slot 52, FIG. 1. Near the end of the forward movement of the dispenser platen 138, cross rod 178 strikes pawl release arm 144 to release rocker arm upper pawl 98. Rocker arm drive spring 192 is again free to rotate clutch assembly 75 which lowers the stack of newspapers an amount sufficient to provide clearance for the return of the dispenser platen 138 and prevent a purchaser from fishing out one or more additional papers through the dispensing slot 52.

After the elevator platform has been lowered the prescribed amount, lower pawl 102 engages rocker arm 76 at tooth 104 to hold the platform in the lowered position. Simultaneously, cover plate 286 is dropped onto the top surface of the paper being dispensed, and then drops further when the paper has been fully withdrawn to completely close slot 52. Because of the dwell provided by timing cam 68 and cam follower 70, there is no movement of parts on the intermediate shaft 74 and back shaft 80 during approximately the last 45° of movement of the outer door 24 to its horizontal position shown in FIG. 1. Thus, it is not necessary for the purchaser to fully open the outer door 24 in order for the mechanism to complete a newspaper dispensing cycle. Spring means automatically close the outer door 24 when the purchaser releases the door handle 25. During the last 45° of closing movement of the outer door 24, the dispenser platen 138 is returned by dispenser platen return spring 196 to its starting position. The last few degrees of outer door 24 closing movement relocks latch 29 and latch keeper 30, and lower pawl 102 is lowered out of engagement with tooth 104 of rocker arm 76 by pawl releasing arm 140. After lower pawl 102 disengages from tooth 104, overrunning clutch release spring 190 releases clutch assembly 75 from back shaft 80. Thereafter, counterbalance spring 216 on back shaft 80 raises the elevator platform 137 to again place the top newspaper into pressure engagement with the underside of the dispensing module 11. The mechanism is now in readiness for another newspaper dispensing cycle.

Dispensing the Display Newspaper

Reference is made to FIGS. 1, 4 and 8. When the last newspaper has been dispensed from the newspaper elevator platform 137, platform probe 136, FIGS. 4 and 8, engages arm 128 of bell crank 126 to rotate bell crank 126 out of latching engagement with latch arm 118. Transmission 67 is now in neutral and rotation of front shaft 64 by reopening outer door 24, will not drive intermediate shaft 74 or back shaft 80. Latch spring 119, FIG. 4, which was energized when the outer door 24 was first opened, pivots latch arm 118 upwardly to disengage outer door latch 38 from latch keeper plate 40. The system is now in readiness to dispense the display newspaper. The purchaser places the proper coins in the coin actuated latch release box 22 to release door latch 29 from latch keeper 30. Since inner door 26 is now unlatched and spring loaded by spring 34, inner door 26 progressively opens as outer door 24 is opened. After outer door 24 has been opened a distance sufficient to enable the purchaser to reach the display paper, the purchaser removes the display paper and permits the outer door 24 to reclose. The vending machine is now sold out and the dispensing and loading mechanisms are in readiness for the deliveryman to load the next edition of newspapers in the vending machine 10.

Miscellaneous (a) The Elevator Platform Shelf

Reference is made to FIG. 4. Newspapers are thickest at their folded portions, and the more newspapers in a stack the more inclined to the horizontal the top newspaper becomes. Since the top newspaper should be substantially horizontal for best results in dispensing by the subject invention, means have been provided to keep the top newspaper sufficiently horizontal for reliable dispensing. To this end, a shelf 300 is secured by hinge means 302 along edge 304 of the elevating platform 137. Leaf springs 306 are secured at their upper edges in the upper corner 308 formed by the shelf horizontal panel 310 and the down turned flange portion 312. The lower edges of leaf springs 306 are secured in the lower corner 314 formed by the shelf vertical panel 316 and the horizontally projecting flange 318. Leaf springs 306 are selected to preload the shaft panel 310 in the horizontal position. When the platform 137 is loaded with newspapers, leaf springs 306 yield sufficiently to provide take up space for the excess caused by the newspaper folded ends. Thereafter, back shaft platform spring 216 and leaf springs 306 coact to maintain the top newspaper in a substantially horizontal plane.

Each indexing of the stack upwardly provides a slight bumping action of the top of the stack with the underside of module 11. This bumping action is obtained by the constant pressure applied to the elevator platform 137 by platform spring 216 and the intermittent release of back shaft 80 by intermittent release of clutch assembly 75. The intermittent bumping of the newspaper stack breaks the frictional bond between the adjacent overlaying folded portions of adjacent newspapers, thereby permitting substantially continuous leveling of the top newspapers. Applicant has discovered that springs which provide proportinate pressure as a function of stack load are incapable of maintaining a level stack because such springs, acting alone, cannot provide the requisite bumping action.

(b) Newspaper Depressor Tongue

To assist in keeping the top newspaper in proper planar alignment for dispensing, a depressor tongue 15, FIGS. 2 and 3, is secured to the inner surface of access panel 28 and is positioned to be received within rectangular recess 322 of dispensing platen 138. Depressor tongue 15 arrests the tendency of the top newspapers to bulge upwardly against the polyurethane pad 230 when the edges of the stack are urged into pressure contact by spring 216 with the lower unyielding surfaces of module side panels 63 and 66. By maintaining the newspapers in substantially horizontal planar alignment prior to dispensing, they will hold this configuration during the brief interval when stack pressure is released by lowering the elevator platform just prior to a dispensing cycle. The top newspaper is then dispensed while it is still substantially flat.

(c) Stack Alignment Guides

Referring to FIG. 2, inclined guide plates 65 extend upwardly from the lower back edge 324 of rear cabinet panel 19 to the front edge 326 of ledge 59. Plates 54, being inclined forwardly from bottom to top, serve to align the newspapers on the elevator platform 137 as they are progressively moved upwardly toward the dispensing module side rails 236 and 238. This guide plate automatic alignment feature, the yieldable shelf 300 and the newspaper anti-bulge newspaper depressor tongue 15 each contribute to the consistent and reliable performance of the dispensing module 11.

(d) Alternative Slot Cover Plate

Figure 17:
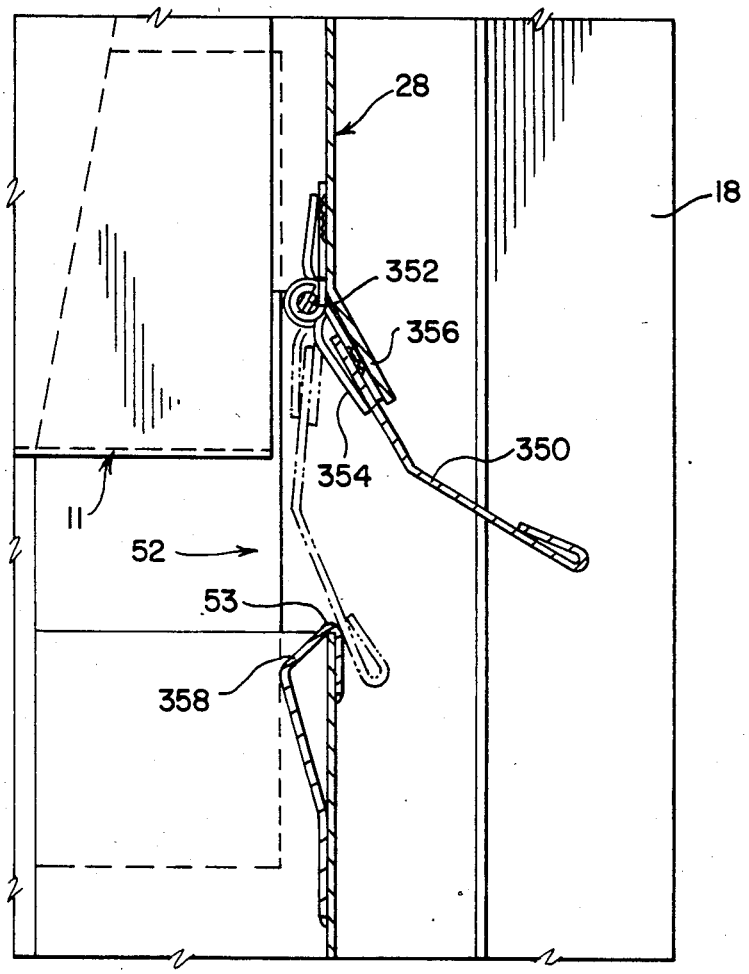

In another preferred embodiment of the invention, as shown in FIG. 17, in lieu of the sliding plate 286 shown in FIGS. 1 and 16, slot cover plate 350 is secured by a hinge 352 immediately above horizontal dispensing slot 52. A spring 354 is secured to hinge 352 to urge cover plate 350 into the open position as shown. A lip 356 extending down from the upper portion of access door 28 forms an angle of 30° to the vertical and acts to delimit the outward swing of cover plate 350 when outer door 24 is opened. When outer door 24 is closed, spring 354 permits cover plate 350 to be biased to the position shown in plantom. The width of cover plate 350 from top to bottom is selected so as to obstruct horizontal access to horizontal slot 52. As shown, for a newspaper to be fished out of the cabinet 12, it would be necessary to insert a tool or finger in an upwardly direction and then reverse direction downwardly to reach a top newspaper. Since the stack of newspapers will have been lowered considerably beneath slot lower edge 53 before the horizontal slot 52 becomes accessible to a fishing tool, to extract a newspaper under these conditions would take more time and effort than the extracted newspaper is worth. Furthermore, it would require a unique combination of knowledge of the invention, manual dexterity and specialized tools to defeat the dispensing mechanism in any event.

By adding a paper guide 358 to the slot lower edge 53, a narrower dispensing slot 52 can be used than would be required without the slot.

Having described preferred embodiments of the invention, it will be clear to those skilled in the art that additional embodiments, modifications and improvements may be made without departing from the intended scope of the invention as defined in the appended claims.

Having thus described the invention, it is claimed:

1. The method of automatically dispensing a single top copy of a vertical stack of newspapers from a newspaper storage cabinet having a means of single copy newspaper egress in a wall of said cabinet comprising the steps of:

(a) urging said stack of newspapers upwardly into pressure contact with stop means in said cabinet;

(b) lowering said stack of newspapers a first time to relieve said pressure just prior to applying said horizontal force;

(c) selecting a platen to rest on the top surface of said top newspaper, having a coefficient of friction between said platen and said top newspaper substantially in excess of the coefficient of friction between said top newspaper and the newspaper next subjacent to said top newspaper, and having sufficient mass that the downward force on the top surface of said top newspaper due to said mass creates a frictional bond between said platen and said top newspaper substantially in excess of the frictional bond between said top newspaper and said next subjacent newspaper;

(d) applying a non-destructive first horizontal force to said platen in the direction of said egress means of sufficient magnitude to rapidly accelerate and to impart momentum to said platen and to said top newspaper simultaneously while shearing the frictional bond between said top newspaper and said next subjacent newspaper;

(e) arresting the horizontal movement of said platen sufficiently rapidly to shear the frictional bond between said platen and said top newspaper;

(f) permitting the momentum of said top newspaper to freely project said top newspaper at least partially through said egress means;

(g) lowering said stack of newspapers a second time to provide clearance for the return of said platen away from said egress means; and (h) applying a second horizontal force to said platen in a direction away from said egress means sufficient to return said platen to its position of rest prior to said first application of horizontal force.

2. The method of dispensing a single top newspaper from a vertical stack of newspapers stored in a newspaper vending cabinet having a means of single copy newspaper egress from said cabinet comprising the steps of:

(a) positioning a newspaper dispensing means above said stack of newspapers and to the rear of said cabinet;

(b) restraining said dispensing means in said position against dispensing a newspaper;

(c) raising said stack of newspapers upwardly into pressure contact with stop means in said cabinet subsequent to positioning said dispensing means above said stack of newspapers and to the rear of said cabinet;

(d) lowering said stack of newspapers prior to releasing said dispensing means;

(e) bringing said dispensing means into pressure contact with said top newspaper;

(f) quickly releasing said restraint on said dispensing means;

(g) quickly accelerating said dispensing means;

(h) frictionally engaging the under surface of said dispensing means with the top surface of said top newspaper sufficient to shear the frictional bond between said top newspaper and the next subjacent newspaper of said stack of newspapers;

(i) moving said top newspaper across the top surface of said subjacent newspaper;

(j) guiding at least a portion of said top newspaper into said egress means;

(k) lowering said stack of newspapers prior to releasing said dispensing means;

(l) returning said dispensing means to the rear of said cabinet; and (m) returning said stack of newspapers upwardly into pressure contact with stop means in said cabinet.

3. The method of claim 2, wherein a high force is applied against said dispensing means to move said dispensing means rapidly toward said egress means.

4. The method of claim 2, including the steps of resting said dispensing means on said top newspaper; and providing pressure sufficiently high and said release sufficiently quick so as to impart substantially instant rapid acceleration to said dispensing means and to said top newspaper, wherein said top newspaper is rapidly and freely projected into said egress means.

5. The method of claim 2, wherein said pressure is sufficiently great, and said release is sufficiently quick to impart rapid acceleration to said dispensing means and to said top newspaper, and wherein the frictional bond between said top newspaper and said subjacent newspaper is sheared and said top newspaper is rapidly and freely projected into said egress means, while said subjacent newspaper remains at rest.

* * * * *